US008973394B2

(12) United States Patent
Yamada et al.

(10) Patent No.: US 8,973,394 B2
(45) Date of Patent: Mar. 10, 2015

(54) DUAL EVAPORATOR UNIT WITH INTEGRATED EJECTOR HAVING REFRIGERANT FLOW ADJUSTABILITY

(75) Inventors: Etsuhisa Yamada, Kariya (JP); Haruyuki Nishijima, Obu (JP); Tomohiko Nakamura, Obu (JP); Gouta Ogata, Nisshin (JP); Hiroshi Oshitani, Toyota (JP); Ryoko Awa, Obu (JP); Tatsuhiko Nishino, Obu (JP); Mika Gocho, Obu (JP)

(73) Assignee: Denso Corporation, Kariya (JP)

( * ) Notice: Subject to any disclaimer, the term of this patent is extended or adjusted under 35 U.S.C. 154(b) by 1284 days.

(21) Appl. No.: 12/655,815

(22) Filed: Jan. 7, 2010

(65) Prior Publication Data

US 2010/0175422 A1 Jul. 15, 2010

(30) Foreign Application Priority Data

Jan. 12, 2009 (JP) ..... 2009-004148
Nov. 26, 2009 (JP) ..... 2009-268351

(51) Int. Cl.
*F25B 15/00* (2006.01)
*F25B 41/00* (2006.01)
*F25B 5/00* (2006.01)

(52) U.S. Cl.
CPC . *F25B 41/00* (2013.01); *F25B 5/00* (2013.01); *F25B 2341/0011* (2013.01); *F25B 2341/0013* (2013.01); *F25B 2500/01* (2013.01); *F25B 2500/18* (2013.01)
USPC ..... 62/500; 62/512; 62/527

(58) Field of Classification Search
USPC ..... 62/500, 512, 527
See application file for complete search history.

(56) References Cited

U.S. PATENT DOCUMENTS 7,299,645 B2 * 11/2007 Oshitani et al. ..... 62/191
7,513,128 B2 4/2009 Yamada et al.

(Continued)

FOREIGN PATENT DOCUMENTS

| | | |
|---|---|---|
| JP | 2007-046806 | 2/2007 |
| JP | 2007-192503 | 8/2007 |
| JP | 2007-333292 | 12/2007 |
| JP | 2008-051397 | 3/2008 |
| JP | 2008-209066 | 9/2008 |
| JP | 2008-309467 | 12/2008 |

OTHER PUBLICATIONS

Office action dated Feb. 5, 2013 in corresponding Japanese Application No. 2009-268351.
Office Action issued Sep. 24, 2013 in corresponding JP Application No. 2009-268351 (with English translation).
Office action dated Jul. 15, 2014 in corresponding Japanese Application No. 2013-265862.

*Primary Examiner* — Lakiya Rogers
*Assistant Examiner* — David Teitelbaum
(74) *Attorney, Agent, or Firm* — Harness, Dickey & Pierce, PLC

(57) ABSTRACT

In an evaporator unit, a first evaporator is coupled to an ejector to evaporate refrigerant flowing out of the ejector, a second evaporator is coupled to a refrigerant suction port of the ejector to evaporate the refrigerant to be drawn into the refrigerant suction port, a flow amount distributor is located to adjust a flow amount of the refrigerant distributed to the nozzle portion and a flow amount of the refrigerant distributed to the second evaporator, and a throttle mechanism is provided between the flow amount distributor and the second evaporator to decompress the refrigerant flowing into the second evaporator. The flow amount distributor is adapted as a gas-liquid separation portion and as a refrigerant distribution portion for distributing separated refrigerant into the nozzle portion and the second evaporator. Furthermore, the flow amount distributor and the ejector are arranged in line in a longitudinal direction of the ejector.

24 Claims, 19 Drawing Sheets

(56) References Cited

U.S. PATENT DOCUMENTS

| | | | | |
|---|---|---|---|---|
| 2005/0028552 | A1* | 2/2005 | Nishijima et al. | 62/500 |
| 2006/0254308 | A1* | 11/2006 | Yokoyama et al. | 62/500 |
| 2007/0028630 | A1* | 2/2007 | Yamada et al. | 62/170 |
| 2007/0169510 | A1 | 7/2007 | Ishizaka et al. | |
| 2007/0186572 | A1* | 8/2007 | Nishida et al. | 62/170 |
| 2007/0289318 | A1 | 12/2007 | Nakamura | |
| 2008/0264097 | A1 | 10/2008 | Ishizaka et al. | |
| 2010/0132400 | A1 | 6/2010 | Sugiura | |

* cited by examiner

DUAL EVAPORATOR UNIT WITH INTEGRATED EJECTOR HAVING REFRIGERANT FLOW ADJUSTABILITY

CROSS REFERENCE TO RELATED APPLICATION

This application is based on Japanese Patent Applications No. 2009-004148 filed on Jan. 12, 2009, and No. 2009-268351 filed on Nov. 26, 2009, the contents of which are incorporated herein by reference in its entirety.

FIELD OF THE INVENTION

The present invention relates to an evaporator unit, which can be suitably used for an ejector refrigerant cycle device, for example.

BACKGROUND OF THE INVENTION

An ejector refrigerant cycle device is, known in JP 2007-46806A (corresponding to U.S. Pat. No. 7,513,128B2), for example. In the refrigerant cycle device, a branch portion for branching refrigerant flowing out of a refrigerant radiator is located upstream of an ejector, such that the refrigerant of one stream branched at the branch portion flows into a nozzle portion of the ejector and the refrigerant of the other stream branched at the branch portion flows into a refrigerant suction port of the ejector. The ejector is adapted to decompress the refrigerant and to circulate the refrigerant in the refrigerant cycle device.

In the refrigerant cycle device, a first evaporator is located downstream of a diffuser portion of the ejector to evaporate the refrigerant flowing out of the diffuser portion of the ejector, and a throttle portion and a second evaporator are located in a refrigerant passage between the branch portion and the refrigerant suction port of the ejector so that the branched refrigerant after being decompressed in the throttle portion is evaporated by the second evaporator. Therefore, cooling and refrigerating capacity can be obtained in both the first evaporator and the second evaporator.

Furthermore, in the refrigerant cycle device, a gas-liquid separator is located in the branch portion to adjust the dryness of the refrigerant, so that gas refrigerant separated in the gas-liquid separator flows into the nozzle portion of the ejector and liquid refrigerant separated in the gas-liquid separator flows into the refrigerant passage in which the throttle portion and the second evaporator are located. The liquid refrigerant is separated at the gas-liquid separator in a centrifugal manner or a weight manner.

However, JP 2007-46806A does not describe regarding the assemble structure of the components in the refrigerant cycle device, and, thereby mounting performance of the refrigerant cycle device to a vehicle may be deteriorated based on the assemble structure of the components.

SUMMARY OF THE INVENTION

In view of the foregoing problems, it is an object of the present invention to provide an evaporator unit provided with a flow amount distributor and an ejector, which are arranged in line in a longitudinal direction of the ejector.

It is another object of the present invention to provide an evaporator unit in which plural components are integrally assembled for a refrigerant cycle device, thereby improving mounting performance of the refrigerant cycle device.

According to an aspect of the present invention, an evaporator unit for a refrigerant cycle device includes: an ejector that is provided with a nozzle portion configured to decompress refrigerant and a refrigerant suction port from which, refrigerant is drawn by a high-speed refrigerant flow jetted from the nozzle portion, and is configured such that the refrigerant jetted from the nozzle portion and the refrigerant drawn from the refrigerant suction port are mixed and the mixed refrigerant is discharged from an outlet of the ejector; a first evaporator coupled to the outlet of the ejector to evaporate the refrigerant flowing out of the outlet of the ejector; a second evaporator coupled to the refrigerant suction port to evaporate the refrigerant to be drawn into the ejector from the refrigerant suction port; a flow amount distributor that is connected to a refrigerant inlet side of the nozzle portion, is located at a position upstream of the second evaporator in a refrigerant flow, and is configured to adjust a flow amount of the refrigerant distributed to the nozzle portion and a flow amount of the refrigerant distributed to the second evaporator; and a throttle mechanism provided between the flow amount distributor and the second evaporator to decompress the refrigerant flowing into the second evaporator. In the evaporator unit, the ejector, the first evaporator, the second evaporator, the flow amount distributor and the throttle mechanism are assembled integrally. The flow amount distributor is adapted as both of a gas-liquid separation portion separating the refrigerant flowing therein into gas refrigerant and liquid refrigerant, and a refrigerant distribution portion for distributing the separated refrigerant into the nozzle portion and the second evaporator. Furthermore, in the evaporator unit, the flow amount distributor and the ejector are arranged in line in a longitudinal direction of the ejector. Accordingly, mounting performance of the refrigerant cycle device including the evaporator unit can be improved.

For example, the first and second evaporators may be arranged adjacent to each other in an air flow direction, and each of the first evaporator and the second evaporator may include a plurality of tubes in which the refrigerant flows and a tank disposed at one end side of the tubes and extending in a tank longitudinal direction to distribute the refrigerant into the tubes or to collect the refrigerant from the tubes. In this case, the ejector, the flow amount distributor and the throttle mechanism may be assembled to an outer surface of the tanks of the first and second evaporators on a side opposite to the tubes.

Furthermore, the tank of the first evaporator may be provided with a first refrigerant distribution tank portion in which the refrigerant flowing out of the ejector is distributed into the tubes of the first evaporator, and the tank of the second evaporator may be provided with a second refrigerant distribution tank portion in which the refrigerant decompressed by the throttle mechanism is distributed into the tubes of the second evaporator. In this case, the evaporator unit may further include a refrigerant storage member located in at least one of the first and second refrigerant distribution tank portions to store the liquid refrigerant, and the refrigerant storage member may be configured such that the refrigerant overflowing from the refrigerant storage member flows into the tubes.

The ejector, the first evaporator, the second evaporator, the flow amount distributor and the throttle mechanism may be brazed as an integrated unit.

Alternatively/Further, the evaporator unit may be further provided with an ejector case in which the ejector is accommodated. In this case, the ejector, the first evaporator, the second evaporator, the flow amount distributor, the throttle mechanism and the ejector case can be assembled integrally.

Furthermore, the ejector, the first evaporator, the second evaporator, the flow amount distributor, the throttle mechanism and the ejector case may be assembled to an outer surface of the tanks of the first and second evaporators, on a side opposite to the tubes.

The flow amount distributor may have a cylindrical outer wall surface, and the ejector case may have a cylindrical outer wall surface. In this case, the cylindrical outer wall surface of the flow amount distributor and the cylindrical outer wall surface of the ejector case may be arranged in line to continuously extend in the longitudinal direction of the ejector.

In the above any evaporator unit, the throttle mechanism may be a taper-straight combination nozzle having approximately a funnel shape. In this case, the taper-straight combination nozzle can be configured by a taper portion in which an inner diameter is reduced as toward downstream in a refrigerant flow, and a straight portion having a constant inner diameter and extending from a downstream end of the taper portion.

Alternatively, the flow amount distributor may be configured to have a cylindrical space portion extending in a horizontal direction, a first outlet port provided at an axial end portion of the cylindrical space portion such that the refrigerant in the cylindrical space portion flows toward the nozzle portion via the first outlet port, and a second outlet port provided in a cylindrical wall surface of the cylindrical space portion such that the refrigerant in the cylindrical space portion flows toward the throttle mechanism via the second outlet port. In this case, the second outlet port may be provided at a position lower than the first outlet port, or/and the nozzle portion may have an inlet port that is directly connected to the first outlet port, or/and the throttle mechanism may be directly connected to the second outlet port. Furthermore, the flow amount distributor may be configured such that the refrigerant flows in the cylindrical space portion to be swirled therein.

Alternatively, the flow amount distributor may include a cylindrical wall portion defining a cylindrical space portion, the cylindrical wall portion may be configured by a plurality layers overlapped with other, and the throttle mechanism may be configured by a helical groove provided between adjacent layers of the cylindrical wall portion. Because the throttle mechanism can be located inside the flow amount distributor, the entire size of the evaporator unit can be further reduced.

Alternatively, the flow amount distributor may include a cylindrical wall portion defining therein a cylindrical space portion, a swirl generating portion configured to generate a swirl movement in the refrigerant flowing from an inlet port into the cylindrical space portion, and the throttle mechanism may be provided in the cylindrical wall portion.

Furthermore, the ejector may include a body member for defining a mixing portion in which the refrigerant jetted from the nozzle portion and the refrigerant drawn from the refrigerant suction portion are mixed and for defining a diffuser portion in which a pressure of the mixed refrigerant is increased by converting speed energy of the mixed refrigerant to pressure energy thereof, and the nozzle portion may be configured by a nozzle forming member. In this case, the nozzle forming member may be provided in the body member, and the cylindrical wall portion of the flow amount distributor may be molded integrally with the body member. Furthermore, the cylindrical wall portion of the flow amount distributor may be configured by a plurality of layers overlapped with each other, and the throttle mechanism may be provided between adjacent layers in the cylindrical wall portion of the flow amount distributor.

Alternatively, the ejector may include a body member for defining a mixing portion in which the refrigerant jetted from the nozzle portion and the refrigerant drawn from the refrigerant suction portion are mixed and for defining a diffuser portion in which a pressure of the mixed refrigerant is increased by converting speed energy of the mixed refrigerant to pressure energy thereof, and the nozzle portion may be configured by a nozzle forming member integrated with the body member. In this case, the flow amount distributor may be configured by the nozzle forming member at a position, upstream of the nozzle portion.

BRIEF DESCRIPTION OF THE DRAWINGS

Additional objects and advantages of the present invention will be more readily apparent from the following detailed description of preferred embodiments when taken together with the accompanying drawings. In which.

DETAILED DESCRIPTION OF THE PREFERRED EMBODIMENTS

First Embodiment

A first embodiment of the present invention will be described below with reference to FIGS. 1A to 5B. In the present embodiment, an evaporator unit of the present invention will be typically used for a refrigerant cycle device. The evaporator unit for the refrigerant cycle device is an integrated evaporator unit in which plural components of a refrigerant cycle, such as an evaporator, an ejector and a flow amount distributor, are integrally disposed.

The integrated evaporator unit is connected to other components of the refrigerant cycle, including a condenser, a compressor, and the like, via piping to constitute a refrigerant cycle device with an ejector. The integrated evaporator unit of the embodiment is used for an indoor equipment (e.g., evaporator) for cooling air. The integrated evaporator unit may be used as an outdoor equipment in other embodiments.

Figure 1A:
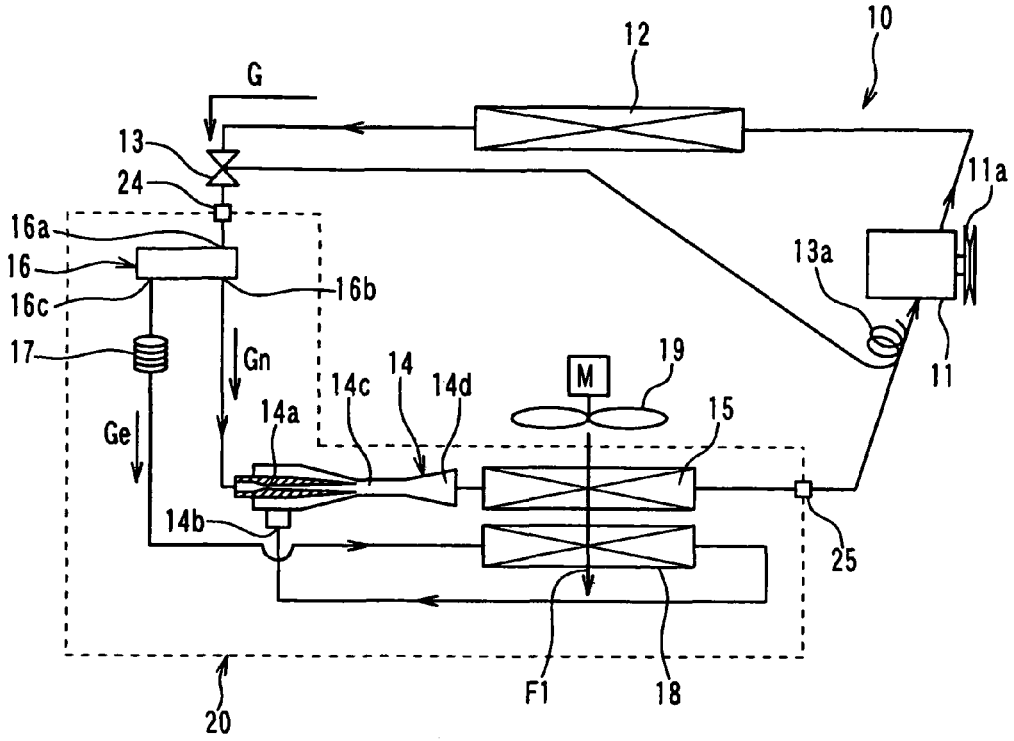
FIG. 1A is a schematic diagram showing a refrigerant cycle device with an ejector.
Figure 1B:
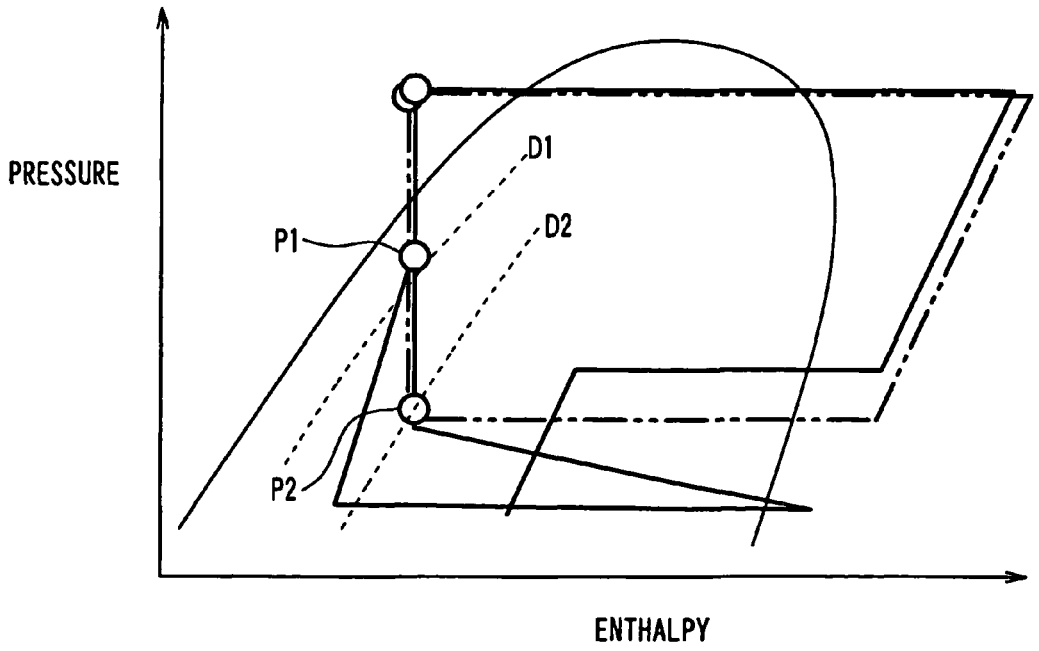
FIG. 1B is a diagram showing the relationship between a pressure and an enthalpy in a refrigerant cycle of the refrigerant cycle device, according to a first embodiment of the present invention.

FIG. 1A shows an example of an ejector refrigerant cycle device 10 for a vehicle according to the first embodiment, and FIG. 1B is a Mollier diagram showing the relationship between a pressure and an enthalpy in the ejector refrigerant cycle device 10 in FIG. 1A.

In the Mollier diagram shown in FIG. 1B, the solid line indicates the operation state of the ejector refrigerant cycle device 10 of the present embodiment, and the chain line indicates the operation state of a comparative refrigerant cycle device without an ejector, in which refrigerant is circulated in this order of a compressor, a condenser, an expansion valve, an evaporator and the compressor.

In the ejector refrigerant cycle device 10 of FIG. 1A, a compressor 11 for drawing and compressing refrigerant is driven by an engine for vehicle traveling (not shown) via an electromagnetic clutch 11*a*, a belt, or the like.

As the compressor 11, may be used either a variable displacement compressor which can adjust a refrigerant discharge capability by a change in discharge capacity, or a fixed displacement compressor which can adjust a refrigerant discharge capability by changing an operating ratio of the compressor through engagement and disengagement of the electromagnetic clutch 11*a*. If an electric compressor is used as the compressor 11, the refrigerant discharge capability can be adjusted or regulated by adjustment of the number of revolutions of an electric motor.

A refrigerant radiator 12 is disposed at a refrigerant discharge side of the compressor 11. The radiator 12 exchanges heat between the high-pressure refrigerant discharged from the compressor 11 and an outside air (i.e., air outside a compartment of a vehicle) blown by a cooling fan (not shown), thereby to cool the high-pressure refrigerant.

As the refrigerant for the ejector refrigerant cycle device 10 in the embodiment, is used a refrigerant whose high pressure does not exceed a critical pressure, such as a flon-based refrigerant, or a HC-based refrigerant, so as to form a vapor-compression subcritical cycle. Thus, the radiator 12 serves as a condenser for cooling and condensing the refrigerant therein.

A thermal expansion valve 13 is disposed at a refrigerant outlet side of the radiator 12. The thermal expansion valve 13 is a decompression unit for decompressing the refrigerant flowing from the radiator, and includes a temperature sensing part 13*a* disposed in a refrigerant suction passage of the compressor 11.

The thermal expansion valve 13 detects a degree of superheat of the refrigerant at the compressor suction side based on the temperature or/and pressure of the suction side refrigerant of the compressor 11, and adjusts a valve opening degree (i.e., refrigerant flow amount) such that the superheat degree of the refrigerant on the compressor suction side becomes a predetermined value which is preset, as is known generally in the art.

An ejector 14 is disposed at a refrigerant outlet side of the thermal expansion valve 13. The ejector 14 is adapted as decompression means for decompressing the refrigerant as well as refrigerant circulating means (kinetic vacuum pump) for circulating the refrigerant by a suction effect (entrainment effect) of the refrigerant flow ejected at high speed.

The ejector 14 includes a nozzle portion 14*a* for further decompressing and expanding the refrigerant (i.e., the middle-pressure refrigerant) by restricting a path area of the refrigerant having passed through the thermal expansion valve 13 to a small level, and a refrigerant suction port 14*b* provided in the same space as a refrigerant jet port of the nozzle portion 14*a*, for drawing the vapor-phase refrigerant flowing from a second evaporator 18 as described later.

A mixing portion 14*c* is provided in the ejector 14 on the downstream side part of the nozzle portion 14*a* and the refrigerant suction portion 14*b* in the refrigerant flow, for mixing a high-speed refrigerant flow jetted from the nozzle portion 14*a* and a drawn refrigerant from the refrigerant suction port 14*b*.

A diffuser portion 14*d* serving as a pressure-increasing portion is provided on the downstream side of the refrigerant flow of the mixing portion 14*c* in the ejector 14. The diffuser portion 14*d* is formed in such a manner that a path area of the refrigerant is generally increased toward downstream from the mixing portion 14*c*. The diffuser portion 14*d* serves to increase the refrigerant pressure by decelerating the refrigerant flow, that is, to convert the speed energy of the refrigerant into the pressure energy.

A first evaporator 15 is connected to an outlet (the tip end of the diffuser portion 14*d*) of the ejector 14. The refrigerant outlet side of the first evaporator 15 is connected to a suction side of the compressor 11.

A flow amount distributor 16 is located at a refrigerant outlet side of the thermal expansion valve 13, so as to adjust a refrigerant flow amount Gn flowing into the nozzle portion 14*a* of the ejector 14 and a refrigerant flow amount Ge flowing into the refrigerant suction port 14*b* of the ejector 14 via the second evaporator 18.

The flow amount distributor 16 includes an inlet port 16*a*, a first outlet port 16*b* and a second outlet port 16*c*. The inlet port 16*a* of the flow amount distributor 16 is connected to an outlet side of the thermal expansion valve 13, so that the refrigerant flowing out of the thermal expansion valve 13 flows into the flow amount distributor 16 from the inlet port 16*a*. The first outlet port 16*b* of the flow amount distributor 16 is connected to an inlet side of the nozzle portion 14*a* so that the refrigerant flowing out of the first outlet port 16*b* flows into the nozzle portion 14*a* of the ejector 14. The second outlet port 16*c* of the flow amount distributor 16 is coupled to refrigerant suction port 14*b* of the ejector 14 so that the refrigerant flowing out of the second outlet port 16*c* of the flow amount distributor 16 flows to be drawn into the refrigerant suction port 14*b* of the ejector 14.

A throttle mechanism 17 and a second evaporator 18 is disposed in a refrigerant passage between the second outlet port 16*c* of the flow amount distributor 16 and the refrigerant suction port 14*b* of the ejector 14. The throttle mechanism 17 is disposed upstream of the second evaporator 18 in a refrigerant flow. The throttle mechanism 17 serves as a decompression unit which performs a function of adjusting a refrigerant flow amount into the second evaporator 18. More specifically, the throttle mechanism 17 can be configured by a fixed throttle, such as a capillary tube, or an orifice.

In the first embodiment, both the first and second evaporators 15 and 18 are incorporated into an integrated structure with an arrangement as described later. The two evaporators 15 and 18 are accommodated in a case not shown, and air (air to be cooled) is blown by a common electric blower 19 through an air passage formed in the case in the direction of an arrow F1, so that the blown air is cooled by the two evaporators 15 and 18.

The cooled air by the two evaporators 15 and 18 is fed to a common space to be cooled (not shown). This causes the two evaporators 15 and 18 to cool the common space to be cooled. Among these two evaporators 15 and 18, the first evaporator 15 connected to a main stream path on the downstream side of the ejector 14 is disposed on the upstream side (upwind side) of the air flow F1, while the second evaporator 18 connected to the refrigerant suction port 14*b* of the ejector 14 is disposed on the downstream side (downwind side) of the air flow F1.

When the ejector refrigerant cycle device 10 of the embodiment is used as a refrigerant cycle device for a vehicle air conditioner, the space within the vehicle compartment is a space to be cooled. When the ejector refrigerant cycle device 10 of the embodiment is used for a refrigerant cycle device for a freezer car, the space within the freezer and refrigerator of the freezer car is the space to be cooled.

Figure 2:
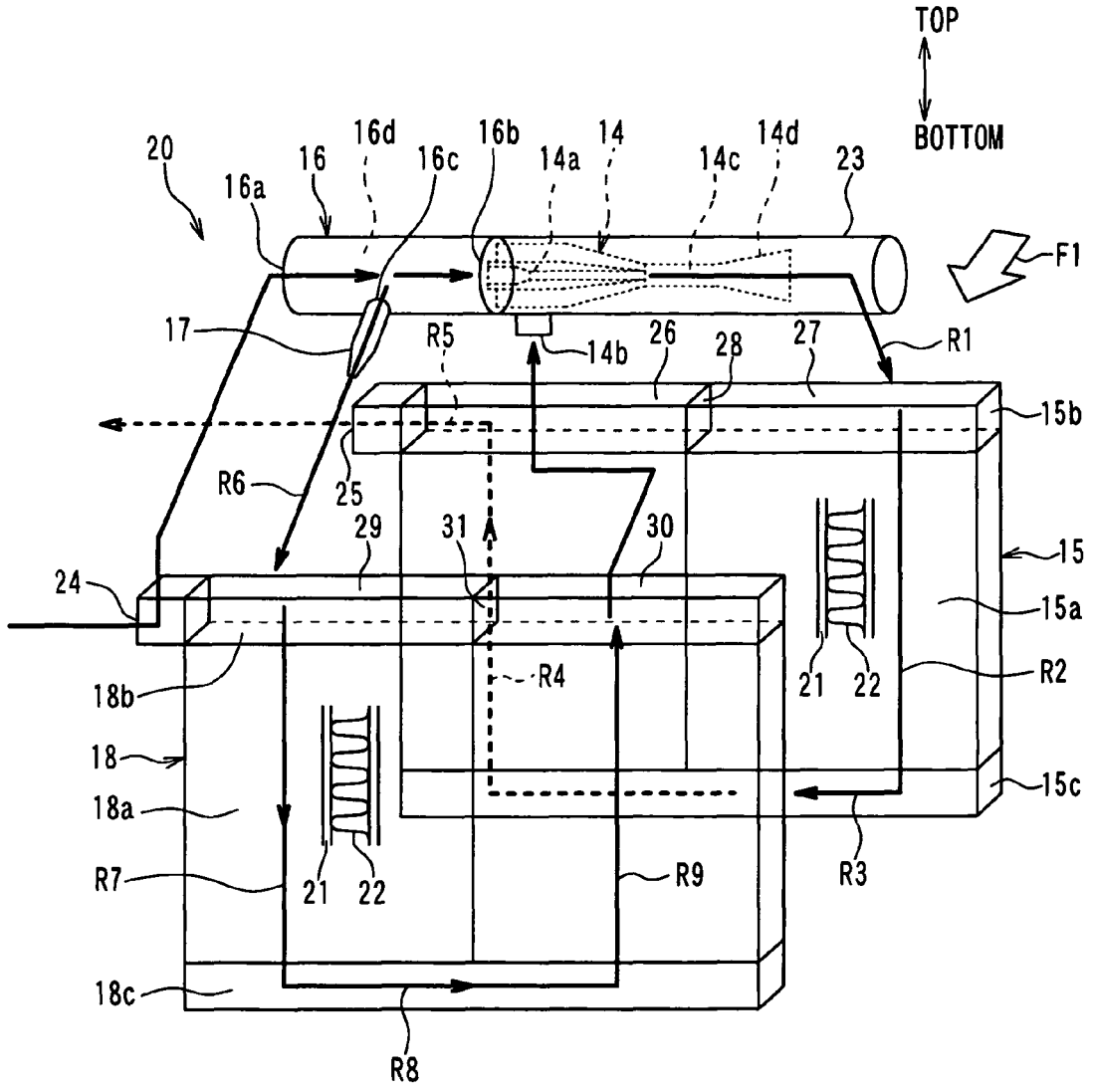
FIG. 2 is a disassembled perspective view showing a schematic structure of an evaporator unit for the refrigerant-cycle device according to the first embodiment.
Figure 3:
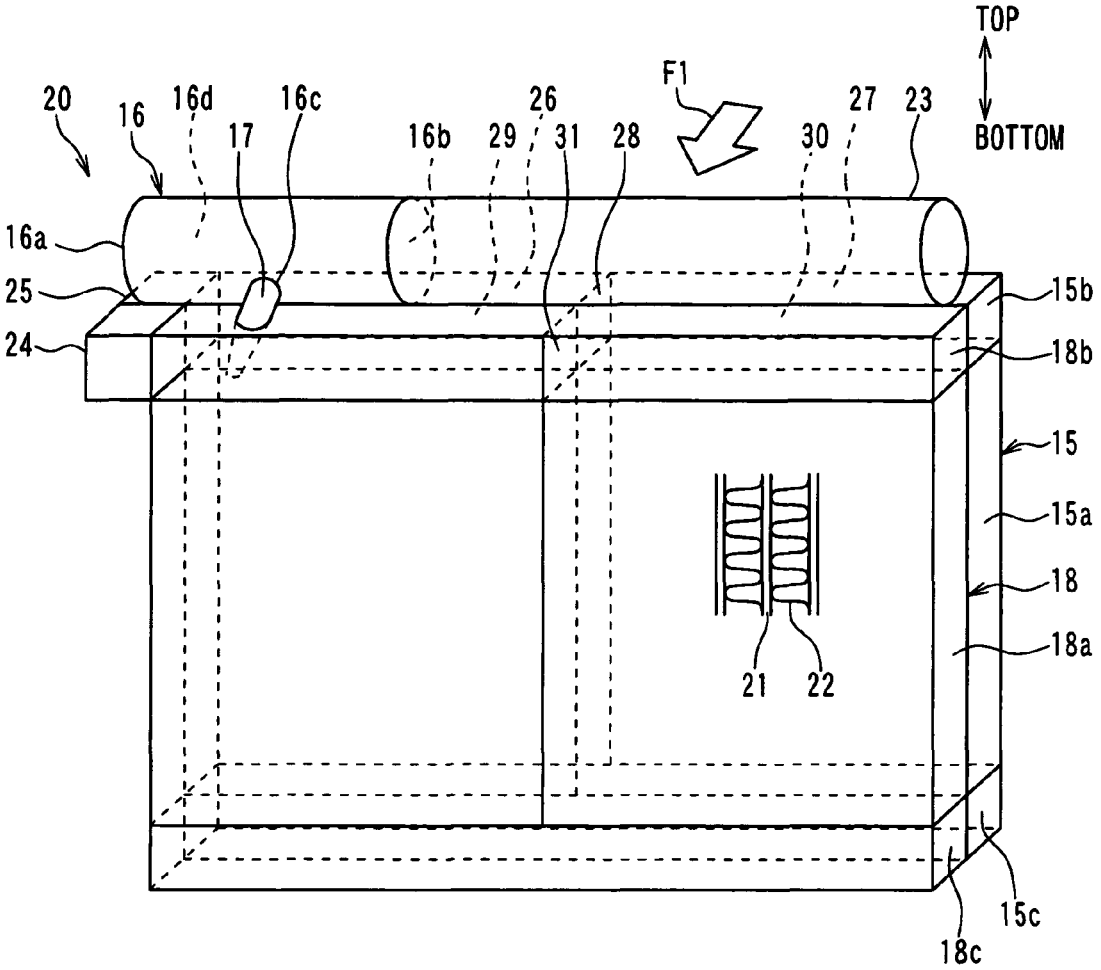
FIG. 3 is a schematic perspective view showing the evaporator unit according to the first embodiment.
Figure 4:
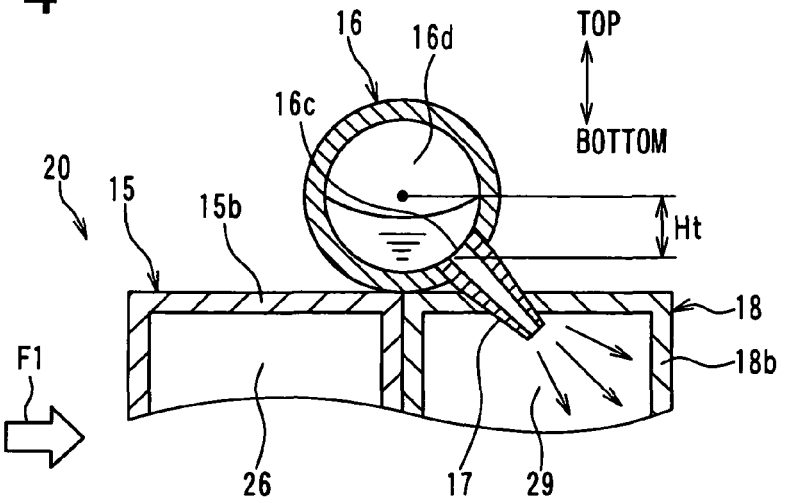
FIG. 4 is a schematic sectional view showing a part of the evaporator unit at a position near a flow amount distributor, according to the first embodiment.

In the embodiment, the ejector 14, the first and second evaporators 15 and 18, and the throttle mechanism 17 are incorporated into one integrated evaporator unit 20. Now, specific examples of the integrated evaporator unit 20 will be described below in detail with reference to FIGS. 2 to 4. FIG. 2 is a disassembled perspective view showing the entire schematic structure of the integrated evaporator unit 20, FIG. 3 is a perspective view showing the integrated evaporator unit 20, and FIG. 4 is a schematic cross-sectional view showing examples of the flow amount distributor 16 of the integrated evaporator unit 20. In FIGS. 2 to 4, the top-bottom direction indicates the top-bottom direction of the integrated evaporator unit 20 when being mounted to a vehicle. In FIG. 3, the indication of the ejector 14 is omitted.

First, an example of the integrated structure including the two evaporators 15 and 18 will be explained below with reference to FIGS. 2 and 3. In the embodiment, the two evaporators 15 and 18 can be formed integrally into a completely single evaporator structure. Thus, the first evaporator 15 constitutes an upstream side area of the single evaporator structure in the direction of the air flow F1, while the second evaporator 18 constitutes a downstream side area of the single evaporator structure in the direction of the air flow F1.

The first evaporator 15 and the second evaporator 18 have the same basic structure, and include heat exchange cores 15*a* and 18*a*, and tanks 15*b*, 15*c*, 18*b*, and 18*c* positioned on both upper and lower sides of the heat exchange cores 15*a* and 18*a*, respectively, to extend horizontal directions (i.e., tank longitudinal directions).

The heat exchanger cores 15*a* and 18*a* respectively include a plurality of tubes 21 extending in a tube longitudinal direction. The tube 21 corresponds to a heat source fluid passage in which a heat source fluid for performing a heat exchange with a heat-exchange medium flows. One or more passages for allowing a heat-exchange medium, namely air to be cooled in the embodiment, to pass therethrough are formed between the tubes 21.

Between these tubes 21, fins 22 are disposed, so that the tubes 21 can be connected to the fins 22. Each of the heat exchange cores 15*a* and 18*a* is constructed of a laminated structure of the tubes 21 and the fins 22. The tubes 21 and the fins 22 are alternately laminated in a lateral direction of the heat exchange cores 15*a* and 18*a*. In other embodiments or examples, any appropriate structure without using the fins 22 in the heat exchange cores 15*a* and 18*a* may be employed.

In FIGS. 2 and 3, only some of the fins 22 are shown, but in fact the fins 22 are disposed over the whole areas of the heat exchange cores 15*a* and 18*a*, and the laminated structure including the tubes 21 and the fins 22 is disposed over the whole areas of the heat exchange cores 15*a* and 18*a*. The blown air by the electric blower 19 is adapted to pass through voids (clearances) in the laminated structure of the heat exchange cores 15*a*, 18*a*.

The tube 21 constitutes the refrigerant passage through which refrigerant flows, and is made of a flat tube having a flat cross-sectional shape in the air flow direction F1. The fin 22 is a corrugated fin made by bending a thin plate in a wave-like shape, and is connected to a flat outer surface of the tube 21 to expand a heat transfer area of the air side.

The tubes 21 of the heat exchanger core 15*a* and the tubes 21 of the heat exchanger core 18*a* independently constitute the respective refrigerant passages. The tanks 15*b* and 15*c* on both the upper and lower sides of the first evaporator 15, and the tanks 18*b* and 18*c* on both the upper and lower sides of the second evaporator 18 independently constitute the respective refrigerant passage spaces (i.e., tank spaces).

Each of the tanks 15*b*, 15*c*, 18*b*, 18*c* of the first and second evaporators 15, 18 extends in an arrangement direction (stack direction) of the tubes 21. For example, in FIGS. 2 and 3, the arrangement direction of the tubes 21 is the left and right direction, which is perpendicular to the air flow direction F1.

The tanks 15*b* and 15*c* on both the upper and lower sides of the first evaporator 15 have tube fitting holes (not shown) into which upper and lower ends of the tube 21 of the heat exchange core 15*a* are inserted and fitted, so that both the upper and lower ends of the tube 21 are communicated with the inside space of the tanks 15*b* and 15*c*, respectively.

Similarly, the tanks 18*b* and 18*c* on both the upper and lower sides of the second evaporator 18 have tube fitting holes (not shown) into which upper and lower ends of the tube 21 of the heat exchange core 18*a* are inserted and fitted, so that both the upper and lower ends of the tube 21 are communicated with the inside space of the tanks 18*b* and 18*c*, respectively.

Thus, the tanks 15*b*, 15*c*, 18*b* and 18*c* disposed on both the upper and lower sides serve to distribute the refrigerant streams to the respective tubes 21 of the heat exchange cores 15*a* and 18*a*, and to collect the refrigerant streams from these tubes 21.

Since the two upper tanks 15*b* and 18*b* are adjacent to each other, the two upper tanks 15*b* and 18*b* can be molded integrally. The same can be made for the two lower tanks 15*c* and 18*c*. It is apparent that the two upper tanks 15*b* and 18*b* may be molded independently as independent components, and that the same can be made for the two lower tanks 15*c* and 18*c*.

Material suitable for use in the evaporator components, such as the tube 21, the fin 22, the tanks 15*b*, 15*c*, 18*b*, and 18*c*, may include, for example, aluminum, which is metal with excellent thermal conductivity and brazing property. By forming each component using the aluminum material, the entire structures of the first and second evaporators 15 and 18 can be assembled, integrally with brazing.

In the embodiment, the ejector 14, the flow amount distributor 16 and the throttle mechanism 17 are arranged on a wall surface of the upper tanks 15*b*, 18*b*, at a side opposite to the tubes 21. In the example of FIGS. 2 and 3, the ejector 14, the flow amount distributor 16 and the throttle mechanism 17 are arranged on an upper side in the upper tanks 15*b*, 18*b*.

The ejector 14 is formed into a thin elongated shape extending in an axial direction of the nozzle portion 14*a*, and is arranged on the upper tanks 15*b*, 18*b* such that the longitudinal direction of the ejector 14 is approximately in parallel with the tank longitudinal direction. In the present embodiment, a cylindrical ejector case 23 is provided on the upper tanks 15*b*, 18*b* so that the ejector 14 is disposed on the upper tanks 15*b*, 18*b* in a state accommodated in the ejector case 23.

The flow amount distributor 16 is formed into a cylindrical shape extending in the tank longitudinal direction (e.g., horizontal direction in FIGS. 2 and 3), so as to form therein a cylindrical space 16*d* extending in the tank longitudinal direction. The inlet port 16*a* is opened at one end portion (e.g., left end portion in FIGS. 2 and 3) of the flow amount distributor 16 in the extending direction, the first outlet port 16*b* opened at the other end portion (e.g., right end portion in FIGS. 2 and 3) of the flow amount distributor 16 in the extending direction, and the second outlet port 16*c* is opened at a cylindrical wall surface of the flow amount distributor 16 toward in a radial direction of the cylindrical shape.

The flow amount distributor 16 is located at an inlet side of the nozzle portion 14*a* of the ejector 14. As shown in FIG. 2, the nozzle portion 14*a* is directly connected to the first outlet port 16*b*. In the present embodiment, the flow amount distributor 16 and the ejector 14 are arranged in line in the longitudinal direction of the ejector 14 in series. Furthermore, the flow amount distributor 16 and an ejector case 23 are formed into a cylindrical shape having a constant outer diameter extending coaxially. That is, the cylindrical outer surface of the flow amount distributor 16 and the cylindrical outer surface of the ejector case 23 continuously extend to form a single cylindrical shape on the upper tanks 15*b*, 18*b*.

In the present embodiment, the throttle mechanism 17 is directly connected to the second outlet port 16*c*, and protrudes from the cylindrical outer surface of the flow amount distributor 16 radially outside into the upper tank 18*b*.

The components of the evaporators 15, 18, such that the tubes 21, the fins 22, the tanks 15*b*, 15*c*, 18*b*, 18*c* and the like, can be made of a metal having sufficient heat contacting performance and brazing performance, such as an aluminum. Each of the components of the evaporators 15, 18 can be molded by using aluminum. The temporally assembled structure of the evaporators 15, 18 are integrally brazed.

The ejector 14, the flow amount distributor 16, the throttle mechanism 17 and the ejector case 23 can be made of aluminum. In this case, the ejector 14, the flow amount distributor 16, the throttle mechanism 17 and the ejector case 23 may be integrated with the first and second evaporators 15, 18 by brazing so as to form the integrated evaporator unit 20.

The ejector 14, the flow amount distributor 16, the throttle mechanism 17 and the ejector case 23 may be made of a material other than aluminum. For example, the ejector 14, the flow amount distributor 16, the throttle mechanism 17 and the ejector case 23 may be made of resin. In this case, the ejector 14, the flow amount distributor 16, the throttle mechanism 17 and the ejector case 23 can be suitably fixed to the first and second evaporators 15, 18 by using a fixing means such as screwing, so as to form the integrated evaporator unit 20.

The integrated evaporator unit 20 is provided with a single refrigerant inlet 24 and a single refrigerant outlet 25, which are located at one longitudinal end portion (e.g., left end portion in FIGS. 2 and 3) of the upper tanks 15*b*, 18*b* of the first and second evaporators 15, 18. As shown in FIG. 2, the refrigerant inlet 24 is made to communicate with the inlet port 16*a* of the flow amount distributor 16, the refrigerant outlet 25 is made to communicate with the upper tank 15*b* of the first evaporator 15.

A partition plate 28 is located in the inner space of the upper tank 15*b* of the first evaporator 15 at an approximate center in the longitudinal direction, to partition the inner space of the upper tank 15*b* of the first evaporator 15 into a first tank space 26 at one side in the longitudinal direction and a second tank space 27 at the other side in the longitudinal direction. The partition plate 28 is fixed to an inner wall surface of the upper tank 15*b* by brazing, for example.

The first tank space 26 is adapted as a refrigerant collection tank portion into which the refrigerant having passed through the tubes 21 of the first evaporator 15 is collected, and the second tank space 27 is adapted as a refrigerant distribution tank portion from which the refrigerant is distributed into the tubes 21 of the first evaporator 15.

A partition plate 31 is located in the inner space of the upper tank 18*b* of the second evaporator 18 at an approximate center in the longitudinal direction, to partition the inner space of the upper tank 18*b* of the second evaporator 18 into a first tank space 29 at one side in the longitudinal direction and a second tank space 30 at the other side in the longitudinal direction. The partition plate 31 is fixed to an inner wall surface of the upper tank 18*b* by brazing, for example.

The first tank space 29 is adapted as a refrigerant distribution tank portion from which the refrigerant is distributed into the tubes 21 of the second evaporator 18, the second tank space 30 is adapted as a refrigerant collection tank portion into which the refrigerant having passed through the tubes 21 of the second evaporator 18 is collected.

The ejector downstream tip end (e.g., the right end portion in FIG. 2) is configured to form an outlet portion of the ejector 14, and is open into an inner space of the ejector case 23. The inner space of the ejector case 23 is made to communicate with the second inner space 27 of the upper tank 15*b*, so that the refrigerant flowing out of the outlet portion of the ejector 14 flows into the second tank space 27 in the upper tank 15*b* via the inner space of the ejector case 23. The refrigerant suction port 14*b* of the ejector 14 is made to communicate with the second tank space 30 of the upper tank 18*b* of the second evaporator 18.

Next, refrigerant flow passages in the entire integrated evaporator unit 20 will be described. The flow of the refrigerant flowing into the flow amount distributor 16 from the refrigerant inlet 24 is branched into a main stream of the refrigerant flowing toward the nozzle portion 14*a* of the ejector 14 and a branch stream of the refrigerant flowing toward the throttle mechanism 17, as shown in FIG. 2.

The refrigerant of the main stream flowing toward the nozzle portion 14*a* of the ejector 14 passes through the ejector 14 (i.e., the nozzle portion 14*a*→the mixing portion 14*c*→the diffuser portion 14*d*) and is decompressed. The decompressed low-pressure refrigerant flowing out of the ejector 14 flows into the second tank space 27 of the upper tank 15*b* of the first evaporator 15, via the inner space of the ejector case 23 as in the direction of the arrow R1.

The refrigerant in the second tank space 27 moves downward in the tubes 21 positioned at the right side portion in the heat exchange core 15*a* as shown in the direction of the arrow R2, so as to flow into the right side part of the lower tank 15*c*. Within the lower tank 15*c*, a partition plate is not provided, and thus the refrigerant moves from the right side of the lower tank 15*c* to the left side thereof in the direction of the arrow R3.

The refrigerant at the left side part in the lower tank 15*c* moves upward in the tubes 21 positioned on the left side of the heat exchange core 15*a* in the direction of the arrow R4 to flow into the first tank space 26 of the upper tank 15*b*. The refrigerant further flows to the refrigerant outlet 25 in the direction of the arrow R5.

In contrast, the refrigerant of the branch stream flowing toward the throttle mechanism 17 in the cylindrical space 16*d* of the flow amount distributor 16 is decompressed by the throttle mechanism 17, and then the decompressed low-pressure refrigerant (liquid-gas two-phase refrigerant) flows into the first tank space 29 of the upper tank 18*b* of the second evaporator 18 in the direction of the arrow R6.

The refrigerant flowing into the first tank space 29 of the upper tank 18*b* of the second evaporator 18 moves downward in the tubes 21 positioned on the left side of the heat exchange core 18*a* in the direction of the arrow R7 to flow into the left side part of the lower tank 18*c*. Within the lower tank 18*c*, a right and left partition plate is not provided, and thus the refrigerant moves from the left side of the lower tank 18*c* to the right side thereof in the direction of an arrow R8.

The refrigerant on the right side of the lower tank 18*c* moves upward in the tubes 21 positioned on the right side of the heat exchange core 18*a* in the direction of the arrow R9 to flow into the second tank space 30 of the upper tank 18*b*. Since the refrigerant suction port 14*b* of the ejector 14 is in communication with the second tank space 30 of the upper tank 18*b* of the second evaporator 18, the refrigerant in the second tank space 30 is drawn from the refrigerant suction port 14*b* into the ejector 14.

The integrated evaporator unit 20 has the structure of the refrigerant passages as described above. The integrated evaporator unit 20 can be configured to have the single refrigerant inlet 24 and the single refrigerant outlet 25, in the whole of the integrated evaporator unit 20.

Now, an operation of the ejector refrigerant cycle device 10 of the first embodiment will be described. When the compressor 11 is driven by a vehicle engine via the electromagnetic clutch 11*a*, the high-temperature and high-pressure refrigerant compressed by and discharged from the compressor 11 flows into the radiator 12, so that the high-temperature refrigerant is cooled and condensed by the outside air. The high-pressure refrigerant flowing from the radiator 12 passes through the thermal expansion valve 13.

The thermal expansion valve 13 adjusts the degree of valve opening (refrigerant flow amount) such that the superheat degree of the refrigerant at the outlet of the first evaporator 15 (i.e., drawn refrigerant by the compressor 11) becomes a predetermined value, and the high-pressure refrigerant is decompressed by the thermal expansion valve 13. The refrigerant having passed through the thermal expansion valve 13 (middle pressure refrigerant) flows into the refrigerant inlet 24 provided in the integrated evaporator unit 20, and further flows into the cylindrical space 16*d* of the flow amount distributor 16 from the inlet port 16*a*.

The refrigerant flow in the cylindrical space 16*d* of the flow amount distributor 16 is branched into the main stream of the refrigerant flowing into the nozzle portion 14*a* of the ejector 14 via the first outlet port 16*b*, and the branch stream of the refrigerant flowing into the throttle mechanism 17 via the second outlet port 16*c*.

The refrigerant flowing into the ejector 14 is decompressed and expanded by the nozzle portion 14*a*. Thus, the pressure energy of the refrigerant is converted into the speed energy at the nozzle portion 14*a*, and the refrigerant is ejected from the jet port of the nozzle portion 14*a* at high speed. At this time, the pressure drop of the refrigerant is caused at the jet port of the nozzle portion 14*a*, thereby drawing from the refrigerant suction port 14*b*, the refrigerant (vapor-phase refrigerant) of the branch stream having passed through the second evaporator 18.

The refrigerant ejected from the nozzle portion 14*a* and the refrigerant drawn into the refrigerant suction port 14*b* are joined and mixed by the mixing portion 14*c* on the downstream side of the nozzle portion 14*a*, and then flows into the diffuser portion 14*d*. In the diffuser portion 14*d*, the speed (expansion) energy of the refrigerant is converted into the pressure energy by enlarging the path area, resulting in increased pressure of the refrigerant.

The refrigerant flowing out of the diffuser portion 14*d* of the ejector 14 flows through the refrigerant flow passages indicated by the arrows R1 to R5 in FIG. 2, in the first evaporator 15. During this time, in the heat exchange core 15*a* of the first evaporator 15, the low-temperature and low-pressure refrigerant absorbs heat from the blown air in the direction of the arrow F1 so as to be evaporated. The vapor-phase refrigerant evaporated is drawn from the single refrigerant outlet 25 into the compressor 11, and is compressed again by the compressor 11.

The refrigerant of the branch stream flowing from the second outlet port 16*c* of the flow amount distributor 16 toward the throttle mechanism 17 is decompressed by the throttle mechanism 17 to become a low-pressure refrigerant (e.g., liquid-gas two-phase refrigerant). The low-pressure refrigerant flows through the refrigerant flow passages indicated by the arrows R6 to R9 of FIG. 2 in the second evaporator 18. During this time, in the heat exchange core 18*a* of the second evaporator 18, the low-temperature and low-pressure refrigerant absorbs heat from the blown air having passed through the first evaporator 15 to be evaporated. The vapor-phase refrigerant evaporated in the second evaporator 18 is drawn from the refrigerant suction port 14*b* into the ejector 14.

As described above, according to the embodiment, the refrigerant on the downstream side of the diffuser portion 14*d* of the ejector 14 can be supplied to the first evaporator 15, and the refrigerant on the branch stream can be supplied to the second evaporator 18 via the throttle mechanism 17, so that the first and second evaporators 15 and 18 can exhibit cooling effects at the same time. Thus, the cooled air by both the first and second evaporators 15 and 18 can be blown into a space to be cooled, thereby cooling the space to be cooled.

At that time, the refrigerant evaporation pressure of the first evaporator 15 is the pressure of the refrigerant which has been increased by the diffuser portion 14*d*. In contrast, since the outlet side of the second evaporator 18 is connected to the refrigerant suction port 14*b* of the ejector 14, the lowest pressure of the refrigerant which has been decompressed at the nozzle portion 14*a* can act on the second evaporator 18.

Thus, the refrigerant evaporation pressure (refrigerant evaporation temperature) of the second evaporator 18 can be lower than the refrigerant evaporation pressure (refrigerant evaporation temperature) of the first evaporator 15. With respect to the direction of the flow F1 of the blown air, the first evaporator 15 whose refrigerant evaporation temperature is high is disposed on the upstream side, and the second evaporator 18' whose refrigerant evaporation temperature is low is disposed on the downstream side. Thus, both a difference between the refrigerant evaporation temperature of the first evaporator 15 and the temperature of the blown air, and a difference between the refrigerant evaporation temperature of the second evaporator 18 and the temperature of the blown air can be secured.

Thus, both cooling performances of the first and second evaporators 15 and 18 can be exhibited effectively. Therefore, the cooling performance of the common space to be cooled can be improved effectively in the combination of the first and second evaporators 15 and 18. Furthermore, the effect of pressurization by the diffuser portion 14*d* in the ejector 14 increases the pressure of suction refrigerant of the compressor 11, thereby decreasing the driving power of the compressor 11.

In the Mollier diagram shown in FIG. 1B, the solid line shows the operation state of the refrigerant cycle of the present embodiment, the chain line shows the operation state of a comparative refrigerant cycle in which the refrigerant is decompressed only in iso-enthalpy by an expansion valve. The refrigerant pressure P1 at the outlet of the thermal expansion valve 13 in the refrigerant cycle of the present embodiment is greatly higher than the refrigerant pressure P2 at the outlet of the thermal expansion valve of the refrigerant cycle in the comparative example.

The refrigerant dryness D1 at the outlet of the thermal expansion valve 13 in the refrigerant cycle of the present embodiment is smaller than the refrigerant dryness D2 at the outlet of the thermal expansion valve of the refrigerant cycle in the comparative example. Thus, the refrigerant flowing into the flow amount distributor 16 becomes in a gas-liquid two-phase refrigerant, in the present embodiment. As shown in FIG. 4, the gas-liquid two-phase refrigerant is separated within the cylindrical space 16*d* of the flow amount distributor 16 into the liquid refrigerant on the bottom side and the gas refrigerant on the upper side by its weight.

Thus, by suitably setting the position and the open area of the second flow outlet 16*c* of the flow amount distributor 16, the flow amount of the liquid refrigerant flowing into the throttle mechanism 17 can be suitably adjusted, thereby suitably adjusting the dryness of the refrigerant flowing into the throttle mechanism 17. Because the dryness (inlet dryness) of the refrigerant flowing into the throttle mechanism 17 can be suitably adjusted, the dryness of the refrigerant flowing into the nozzle portion 14*a* of the ejector 14 can be also suitably adjusted.

For example, as shown in FIG. 4, a dimension Ht in the top-bottom direction between the center in the circular cross-section of the flow amount distributor 16 and the position of the second outlet port 16*c* can be made larger, so as to set the position of the second outlet port 16*c* at a lower side. By setting the position of the second outlet port 16*c* at the lower side in the cylindrical wall surface of the flow amount distributor 16, or/and by setting the open area of the second outlet port 16*c* to be larger, the flow amount of the liquid refrigerant flowing into the throttle mechanism 17 becomes larger, and thereby the dryness of the refrigerant flowing into the throttle mechanism 17 can be made smaller. At the same time, the dryness of the refrigerant flowing into the nozzle portion 14*a* of the ejector 14 becomes larger.

Conversely, by setting the position of the second outlet port 16*c* at an upper side in the cylindrical wall surface of the flow amount distributor 16, or/and by setting the open area of the second outlet port 16*c* to be smaller, the flow amount of the liquid refrigerant flowing into the throttle mechanism 17 becomes smaller, and thereby the dryness of the refrigerant flowing into the throttle mechanism 17 can be made larger. At the same time, the dryness of the refrigerant flowing into the nozzle portion 14*a* of the ejector 14 becomes smaller.

As described above, because the dryness of the refrigerant at the inlet side of the throttle mechanism 17 and the dryness of the refrigerant at the inlet side of the nozzle portion 14*a* are adjusted, the flow amounts of the refrigerant flowing into the throttle mechanism 17 and the nozzle portion 14*a* of the ejector 14 can be stably adjusted, thereby making the pressure increase in the ejector 14 to be stable in accordance with a load variation in the ejector refrigerant cycle device 10. As a result, the performance (e.g., cooling capacity, COP etc.) of the refrigerant cycle having the ejector 14 can be effectively improved in the refrigeration cycle device 10.

In the present embodiment, the flow amount distributor 16 is adapted as a separation portion for separating the refrigerant flowing in the cylindrical space 16*d* into gas refrigerant and liquid refrigerant, and is also adapted as a refrigerant distribution portion for distributing the gas-liquid refrigerant separated in the cylindrical space 16*d* into the nozzle portion 14*a* and the second evaporator 18.

Figure 5A:
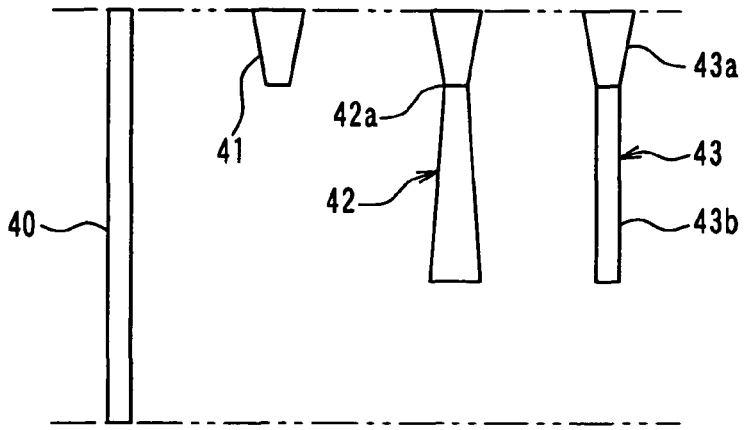
FIG. 5A is a schematic diagram showing examples of a throttle mechanism.

Next, detail structures of the throttle mechanism 17 will be described based on FIGS. 5A and 5B. FIG. 5A shows specific examples used as the throttle mechanism 17. As the throttle mechanism 17, a capillary tube 40, a taper nozzle 41, a Laval nozzle 42 or a taper-straight combination nozzle 43 may be used, for example, as shown in FIG. 5A.

The capillary tube 40 has a constant inner diameter, and adjusts the flow amount based on the pipe friction with the refrigerant flow. The taper nozzle 41 and the Laval nozzle 42 are configured to change its inner diameter in accordance with the density variation of the refrigerant.

For example, the inner diameter of the taper nozzle 41 is made smaller as toward a refrigerant downstream side. The Laval nozzle 42 has a throat portion 42*a* at which the inner diameter (passage sectional area) of the refrigerant passage becomes smallest so that the refrigerant is accelerated to a supersonic speed.

The taper-straight combination nozzle 43 corresponds to a combination nozzle in which the taper nozzle 41 and the capillary tube 40 are combined in line. Specifically, the taper-straight combination nozzle 43 is formed into approximately a funnel shape, to have a taper portion 43*a* in which the inner diameter is reduced as toward downstream of the refrigerant flow, and a straight portion 43*b* extending from the downstream end of the taper portion 43 by a predetermined distance. The straight portion 43*b* has a constant inner diameter that is substantially equal to the inner diameter at the downstream end of the taper portion 43*a*.

Figure 5B:
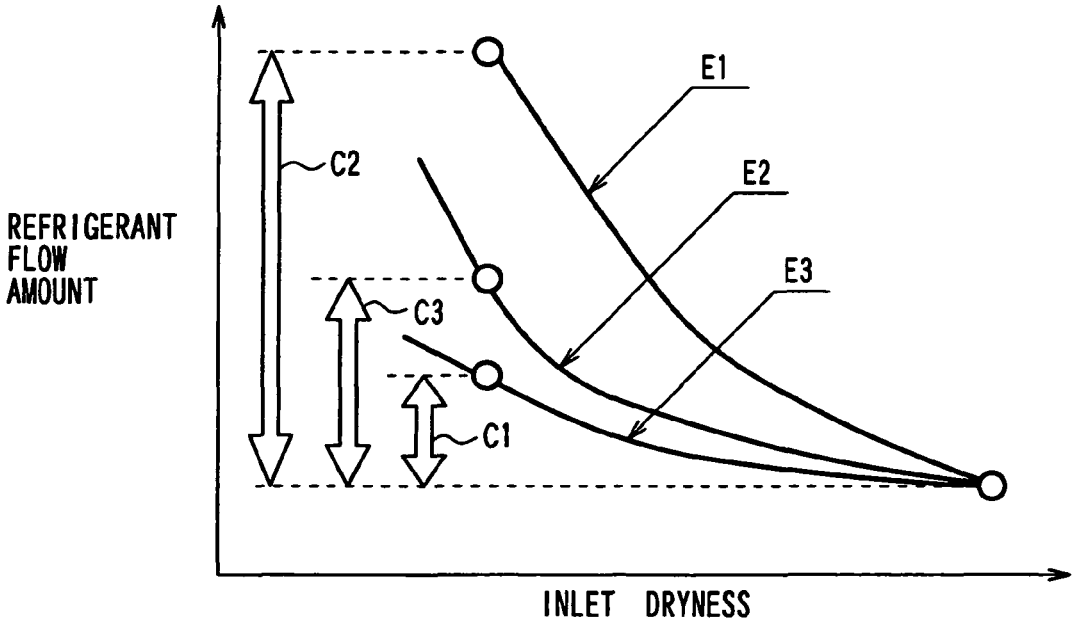
FIG. 5B is a graph showing relationships between a refrigerant flow amount and an inlet dryness of the throttle mechanism in plural examples E1, E2 and E3 of the throttle mechanism shown in FIG. 5A.

FIG. 5B shows the relationship between the dryness (inlet dryness) of the refrigerant at the inlet side of the respective examples 40-43 used as the throttle mechanism, and the refrigerant flow amount. E1 shows the example where the taper nozzle 41 or the Laval nozzle 42 is used as the throttle mechanism 17, E2 shows the example where the taper-straight combination nozzle 43 is used as the throttle mechanism 17, and E3 shows the example where the capillary tube 40 is used as the throttle mechanism 17. The refrigerant dryness at the inlet side of the throttle mechanism 17 is changed in accordance with a load variation in the ejector refrigerant cycle device 10. Therefore, as the throttle mechanism 17, it is proper to have a small variation in the refrigerant flow amount with respect to the variation of the refrigerant dryness at the inlet side of the throttle mechanism 17, in the ejector refrigerant cycle device 10 where the load variation is larger.

In the example E3 in which the capillary tube 40 is used as the throttle mechanism 17, the variation of the refrigerant flow amount relative to the variation of the refrigerant dryness at the inlet side of the throttle mechanism 17 is relatively small as shown in the arrow C1 of FIG. 5B, as compared with the examples E1 and E2. Therefore, when the capillary tube 40 is used as the throttle mechanism 17, the operation of the ejector refrigerant cycle device 10 can be made stable.

Generally, when the capillary tube 40 is used as the throttle mechanism 17 as in the example E3, a ratio (L/D) of the entire length (L) to the inner diameter (D) in the throttle mechanism 17 becomes relatively large as shown in FIG. 5A, and thereby it may be difficult to simply reduce the whole size of the integrated evaporator unit 20.

When the taper nozzle 41 or the Laval nozzle 42 is used as the throttle mechanism 17 as in the example of E1, the ratio (L/D) of the entire length (L) to the inner diameter (D) in the throttle mechanism 17 becomes relatively small as shown in FIG. 5A, and thereby it may be easy to simply reduce the whole size of the integrated evaporator unit 20. In addition, in this case, because the refrigerant can be accelerated to the supersonic speed, the refrigerant distribution performance in the first tank space 29 of the upper lank 18*b* of the second evaporator 18 can be improved.

However, when the taper nozzle 41 or the Laval nozzle 42 is used as the throttle mechanism 17, the variation of the refrigerant flow amount relative to the variation of the refrigerant dryness at the inlet side of the throttle mechanism 17 is relatively large as shown by the arrow C2 of FIG. 5B, and thereby it may be difficult to be used for a refrigerant cycle device operated with a large load variation.

In contrast, when the taper-straight combination nozzle 43 is used as the throttle mechanism 17, it is possible to simply reduce the entire size of the integrated evaporator unit 20 and to make the operation of the ejector refrigerant cycle device 10 in stable. That is, when the taper-straight combination nozzle 43 is used as the throttle mechanism 17, the above problems in the capillary tube 40 and in the taper nozzle 41 or the Laval nozzle 42 can be solved.

The taper-straight combination nozzle 43 corresponds to a combination nozzle combining the capillary tube 40 having a constant inner diameter to the downstream tip end of the taper nozzle 41 in line in an extending direction. In this case, as shown by C3 in FIG. 5B, the variation in the refrigerant flow amount to the refrigerant dryness at the inlet side of the throttle mechanism 17 is a middle between the example of the capillary tube 40 and the example of the taper nozzle 41. In addition, when the taper-straight combination nozzle 43 is used as the throttle mechanism 17, the ratio (L/D) of the entire length (L) to the inner diameter (D) in the throttle mechanism 17 can be made smaller as compared with the example in which the capillary tube 40 is used as the throttle mechanism 17.

In the present embodiment, when the taper-straight combination nozzle 43 is used as the throttle mechanism 17, it is possible to simply reduce the entire size of the integrated evaporator unit 20 and to make the operation of the ejector refrigerant cycle device 10 in stable.

According to the present embodiment, the ejector 14, the first evaporator 15, the flow amount distributor 16, the throttle mechanism 17 and the second evaporator 18 are integrally assembled to form the integrated evaporator unit 20, as shown in FIG. 2, and thereby it is possible for the integrated evaporator unit 20 to have the single refrigerant inlet 24 and the single refrigerant outlet 25.

Thus, when the ejector refrigerant cycle device 10 is mounted to a vehicle, the single refrigerant inlet 24 used for the entire integrated evaporator unit 20 is connected to the thermal expansion valve 13, and the single refrigerant outlet 25 used for the entire integrated evaporator unit 20 is connected to the refrigerant suction side of the compressor 11, thereby finishing the pipe connection operation.

Furthermore, as shown in FIGS. 2 and 3, the ejector 14, the flow amount distributor 16 and the ejector case 23 are integrated on the upper surface of the upper tanks 15*b*, 18*b*, and are elongated entirely in the longitudinal direction, such that the elongated direction corresponds to the longitudinal direction of the upper tanks 15*b*, 18*b*. In the example of FIG. 3, the flow amount distributor 16 and the ejector case 23 are arranged in line to continuously extend in the longitudinal direction of the ejector 14. For example, the outer wall surface of the flow amount distributor 16 and the outer wall surface of the ejector case 23 having therein the ejector 14 are configured to form a continuous cylindrical shape extending in the longitudinal direction of the ejector 14 on the upper tanks 15*b*, 18*b*. Furthermore, the throttle mechanism 17 is connected to the second outlet port 16*c* provided at the cylindrical wall surface of the flow amount distributor 16, and is extended into the upper tank 18*b* of the second evaporator 18, as shown in FIGS. 3 and 4. As a result, the entire size of the integrated evaporator unit 20 can be made smaller and can be assembled simply in compact.

Accordingly, the mounting performance of the ejector refrigerant cycle device 10 having the first and second evaporators 15, 18 to a vehicle can be improved, and the number of components in the ejector refrigerant cycle device 10 can be reduced, thereby reducing the product cost.

Because the connection passage length for connecting the ejector 14, the flow amount distributor 16, the throttle mechanism 17 and the first and second evaporators 15, 18 is made minimum in the integrated evaporator unit 20, pressure loss in the refrigerant passage can be reduced, and heat exchanging amount of the low-pressure refrigerant in the integrated evaporator unit 20 with its atmosphere can be reduced.

Accordingly, the cooling performance of the first and second evaporators 15, 18 can be effectively improved.

Second Embodiment

A second embodiment of the present invention will be described with reference to FIGS. 6A and 6B. In the above-described first embodiment, the single throttle mechanism 17 is attached to the flow amount distributor 16 at a position of the cylindrical wall surface of the flow amount distributor 16. That is, the second outlet port 16*c* is located at one position in the cylindrical wall surface of the flow amount distributor 16. However, in the second embodiment, a plurality of the throttle mechanisms 17 are attached to the cylindrical wall surface of the flow amount distributor 16, as shown in FIGS. 6A and 6B.

Figure 6A:
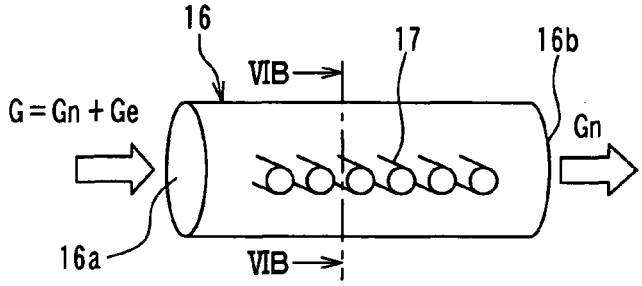
FIG. 6A is schematic perspective view showing a flow amount distributor and a throttle mechanism according to according to a second embodiment of the present invention.
Figure 6B:
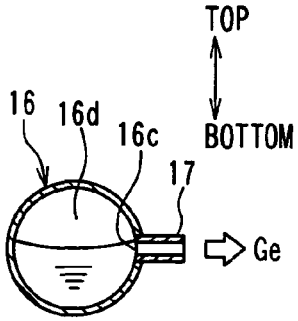
FIG. 6B is cross-sectional view taken along the line VIB-VIB of FIG. 6A.

As shown in FIGS. 6A and 6B, the plural throttle mechanisms 17 are arranged in the axial direction (e.g., the left-right direction in FIG. 6A) of the cylindrical wall surface of the flow amount distributor 16. Specifically, the plural throttle mechanisms 17 are arranged in the arrangement direction of the plural tubes 21, to correspond to the positions of the plural tubes 21 connected to the first tank space 29 of the upper tank 18*b* of the second evaporator 18 in the arrangement direction of the plural tubes 21. Therefore, the distribution performance of the liquid refrigerant into the plural tubes 21 can be improved.

For example, the second outlet ports 16*c* are provided at plural positions of the cylindrical wall surface of the flow amount distributor 16 to be arranged in the axial direction of the flow amount distributor 16, and are connected, respectively, to the plural throttle mechanisms 17.

By suitably changing the open position of the throttle mechanisms 17 opened into the flow amount distributor 16 in the top-bottom direction, or/and by suitably changing the inlet open areas of the throttle mechanisms 17, the flow amount Gn of the refrigerant flowing into the nozzle portion 14*a* of the ejector 14 and the flow amount Ge of the refrigerant flowing into the refrigerant suction port 14*b* of the ejector 14 via the second evaporator 18 can be suitably changed. In the second embodiment, the other parts of the integrated evaporator unit 20 for the ejector refrigerant cycle device 10 can be made similar to those of the above-described first embodiment.

Third Embodiment

Figure 7A:
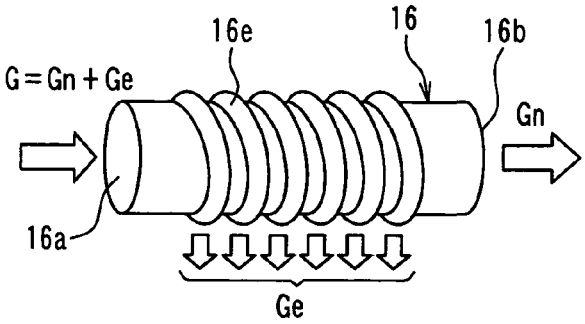
FIGS. 7A and 7B are perspective view and side view, showing a flow amount distributor and a throttle mechanism according to a third embodiment of the present invention.
Figure 7B:
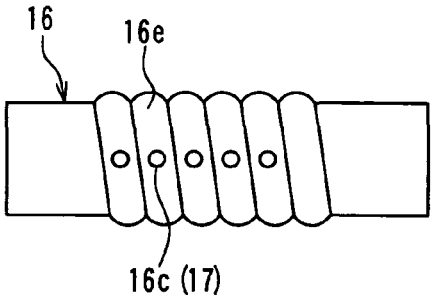

A third embodiment of the present invention will be described with reference to FIGS. 7A and 7B. In the above-described second embodiment, the flow amount distributor 16 is formed into a simple cylindrical shape substantially having a constant outer diameter. However, in the third embodiment, as shown in FIGS. 7A and 7B, a helical groove portion 16*e* is formed in the inner cylindrical wall surface of the flow amount distributor 16 to be recessed from the inner cylindrical wall surface to radially outside in a helical shape, as shown in FIG. 7A. Therefore, a helical protrusion portion is formed on the outer cylindrical wall surface at the position corresponding to the helical groove portion 16*e*.

A plurality of the second outlet ports 16*c* are provided in the helical groove portion 16*e* of the flow amount distributor 16, and a throttle mechanism 17 is configured by the plural second outlet ports 16*c* by adjusting its number and its open areas. The plural second outlet ports 16*c* are arranged in the helical groove portion 16*e* in line in the axial direction of the flow amount distributor 16. The axial direction of the flow amount distributor 16 corresponds to the extending direction of the ejector 14.

According to the third embodiment, because the gas-liquid two-phase refrigerant flowing into the inlet port 16*a* of the flow amount distributor 16 flows in the flow amount distributor 16 while being swirled along the helical groove portion 16*e* of the flow amount distributor 16, liquid film is formed in the groove portion 16*e*. Therefore, the refrigerant can be separated into gas refrigerant and liquid refrigerant by using the centrifugal force in the flow amount distributor 16.

The liquid film generated in the groove portion 16*e* flows into the first tank space 29 of the upper tank 18*b* of the second evaporator 18 via the plural second outlet ports 16*c* adapted as the throttle mechanism 17. Accordingly, distribution performance of the liquid refrigerant from the flow amount distributor 16 into the first tank space 29 of the upper tank 18*b* of the second evaporator 18 can be improved, similarly to the above-described second embodiment. The first tank space 29 is adapted as a refrigerant distribution tank portion in the upper tank 18*b* of the second evaporator 18. Therefore, distribution performance of the liquid refrigerant to the plural tubes 21 of the heat exchange core 18*a* of the second evaporator 18, communicating with the first tank space 29 of the upper tank 18*b*, can be improved.

By suitably changing the number or/and open areas of the second outlet ports 16*c* adapted as the throttle mechanism 17, the flow amount Gn of the refrigerant flowing into the nozzle portion 14*a* of the ejector 14 and the flow amount Ge of the refrigerant flowing into the second evaporator 18 can be suitably changed. In the third embodiment, the other parts of the integrated evaporator unit 20 for the ejector refrigerant cycle device 10 can be made similar to those of the above-described first embodiment.

Fourth Embodiment

A fourth embodiment of the present invention will be described with reference to FIGS. 8A and 8B. In the above-described embodiments, the inlet port 16*a* is provided at the longitudinal end portion of the flow amount distributor 16 to open toward the axial direction of the flow amount distributor 16, for example. Furthermore, in the above-described third embodiment, the helical groove portion 16*e* is provided in the inner cylindrical wall surface of the flow amount distributor 16, so that the gas-liquid refrigerant flowing therein is separated into the gas refrigerant and the liquid refrigerant while being swirled. However, in the fourth embodiment, the inlet port 16*a* is provided at a position shifted from a center of a circular cross section of the flow amount distributor 16 so as to swirl the gas-liquid refrigerant in the cylindrical space 16*d* of the flow amount distributor 16.

Figure 8A:
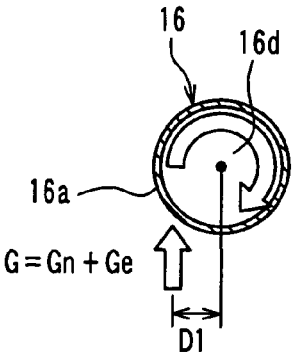
FIGS. 8A and 8B are cross-sectional view and perspective view, showing a flow amount distributor and a throttle mechanism according to a fourth embodiment of the present invention.
Figure 8B:
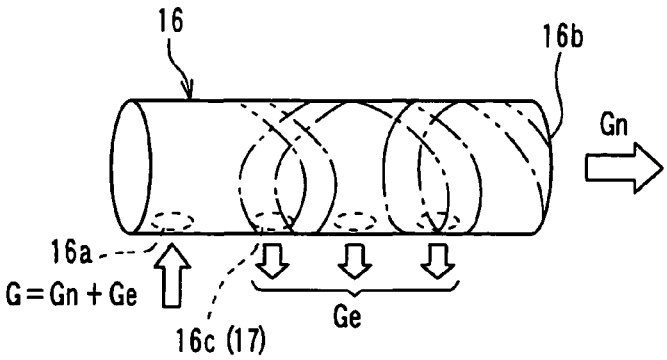

For example, as shown in FIGS. 8A and 8B, the inlet port 16*a* is provided in the flow amount distributor 16 at a position separated from the center of the circular cross section of the flow amount distributor 16 by a dimension D1 so that the gas-liquid refrigerant flowing into the inlet port 16*a* is swirled in the flow amount, distributor 16.

In the example of FIGS. 8A and 8B, the inlet port 16*a* of the flow amount distributor 16 is provided in the cylindrical wall surface of the flow amount distributor 16 at a position close to the longitudinal end, so that the gas-liquid refrigerant flows into the flow amount distributor 16 in a tangential direction of the cylindrical wall surface, thereby swirling the refrigerant flowing into the flow amount distributor 16.

By suitably changing the position of the inlet port 16*a* of the flow amount distributor 16, the width of a liquid film (liquid film width) in the axial direction of the flow amount distributor 16 and the thickness of the liquid film (liquid film thickness) in the radial direction of the flow amount distributor 16 can be suitably changed, and thereby the flow amount Gn of the refrigerant flowing into the nozzle portion 14*a* of the ejector 14 and the flow amount Ge of the refrigerant flowing into the refrigerant suction port 14*b* of the ejector 14 via the second evaporator 18 can be suitably changed. In the fourth embodiment, the other parts of the integrated evaporator unit 20 for the ejector refrigerant cycle device 10 can be made similar to those of the above-described first embodiment.

Fifth Embodiment

Figure 9A:
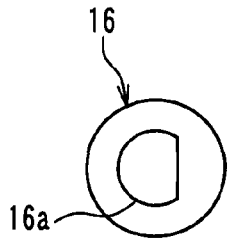
FIGS. 9A and 9B are front view and perspective view, showing a flow amount distributor and a throttle mechanism according to a fifth embodiment of the present invention.
Figure 9B:
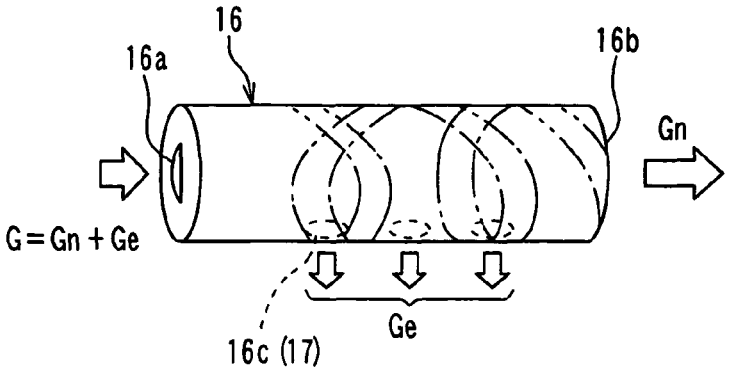

A fifth embodiment of the present invention will be described with reference to FIGS. 9A and 9B. In the above-described fifth embodiment, the inlet port 16*a* is provided at a position shifted from the center of the circular cross section of the flow amount distributor 16 so as to swirl, the gas-liquid refrigerant in the flow amount distributor 16. In the fifth embodiment, as shown in FIGS. 9A and 9B, the shape of the inlet port 16*a* of the flow amount distributor 16 is made non-circularly so that the gas-liquid two-phase refrigerant flowing from the inlet port 16*a* is swirled in the flow amount distributor 16. In the example shown in FIGS. 9A and 9B, the inlet port 16*a* is provided in the longitudinal end to open in the axial direction, and the open shape of the inlet port 16*a* is approximately a D-shape.

By suitably changing the non-circular shape of the inlet port 16*a* of the flow amount distributor 16, the liquid film width and the liquid film thickness in the flow amount distributor 16 can be suitably changed, and thereby the flow amount Gn of the refrigerant flowing into the nozzle portion 14*a* of the ejector 14 and the flow amount Ge of the refrigerant flowing into the refrigerant suction port 14*b* of the ejector 14 via the second evaporator 18 can be suitably changed. In the fifth embodiment, the other parts of the integrated evaporator unit 20 for the ejector refrigerant cycle device 10 can be made similar to those of the above-described first embodiment.

Sixth Embodiment

Figure 10:
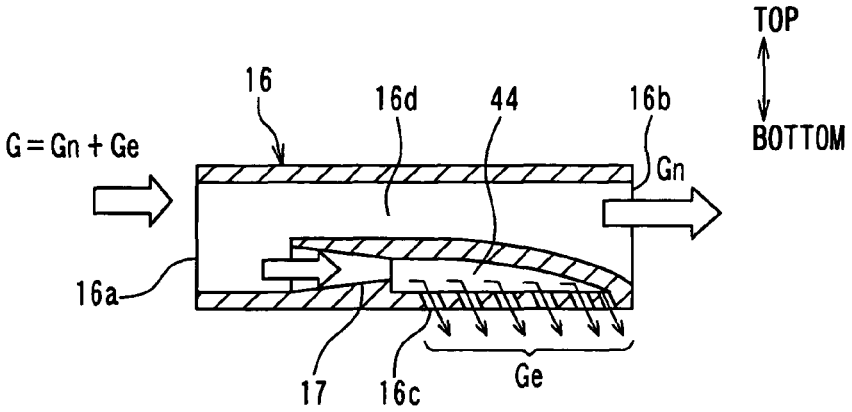
FIG. 10 is a cross-sectional view showing a flow amount distributor and a throttle mechanism according to according to a sixth embodiment of the present invention.

A sixth embodiment of the present invention will be described with reference to FIG. 10. In the above-described second embodiment, the plural throttle mechanisms 17 are attached to the flow amount distributor 16 so as to provide both the throttle function and the refrigerant distribution function. However, in the sixth embodiment, as shown in FIG. 10, only a single throttle mechanism 17 is provided in the flow amount distributor 16, so as to provide both the throttle function and the refrigerant distribution function.

The single throttle mechanism 17 is formed by a taper nozzle or a capillary tube, and is disposed at a lower portion within the flow amount distributor 16 to extend in parallel with the axial direction of the flow amount distributor 16. Furthermore, a space portion 44 is provided downstream of the throttle mechanism 17 within the flow amount distributor 16 at the lower portion to extend directly from the downstream end of the throttle mechanism 17 to downstream in the axial direction of the flow amount distributor 16. Furthermore, plural second outlet ports 16*c* of the flow amount distributor 16 are provided in the cylindrical wall surface of the flow amount distributor 16 at positions facing the space portion 44. The plural second outlet ports 16*c* of the flow amount distributor 16 are arranged in line in the axial direction (ejector longitudinal direction) of the flow amount distributor 16.

Thus, the liquid refrigerant separated at the bottom side of the flow amount distributor 16 passes through the throttle mechanism 17, the space portion 44 and the plural second outlet ports 16*c*, thereby achieving the throttle function and the refrigerant distribution function in the flow amount distributor 16 provided with the throttle mechanism 17.

By suitably changing the number or/and open areas of the second outlet ports 16*c*, the flow amount Gn of the refrigerant flowing into the nozzle portion 14*a* of the ejector 14 and the flow amount Ge of the refrigerant flowing into the refrigerant suction port 14*b* of the ejector 14 via the second evaporator 18 can be suitably changed. In the sixth embodiment, the other parts of the integrated evaporator unit 20 for the ejector refrigerant cycle device 10 can be made similar to those of the above-described first embodiment.

Seventh Embodiment

Figure 11:
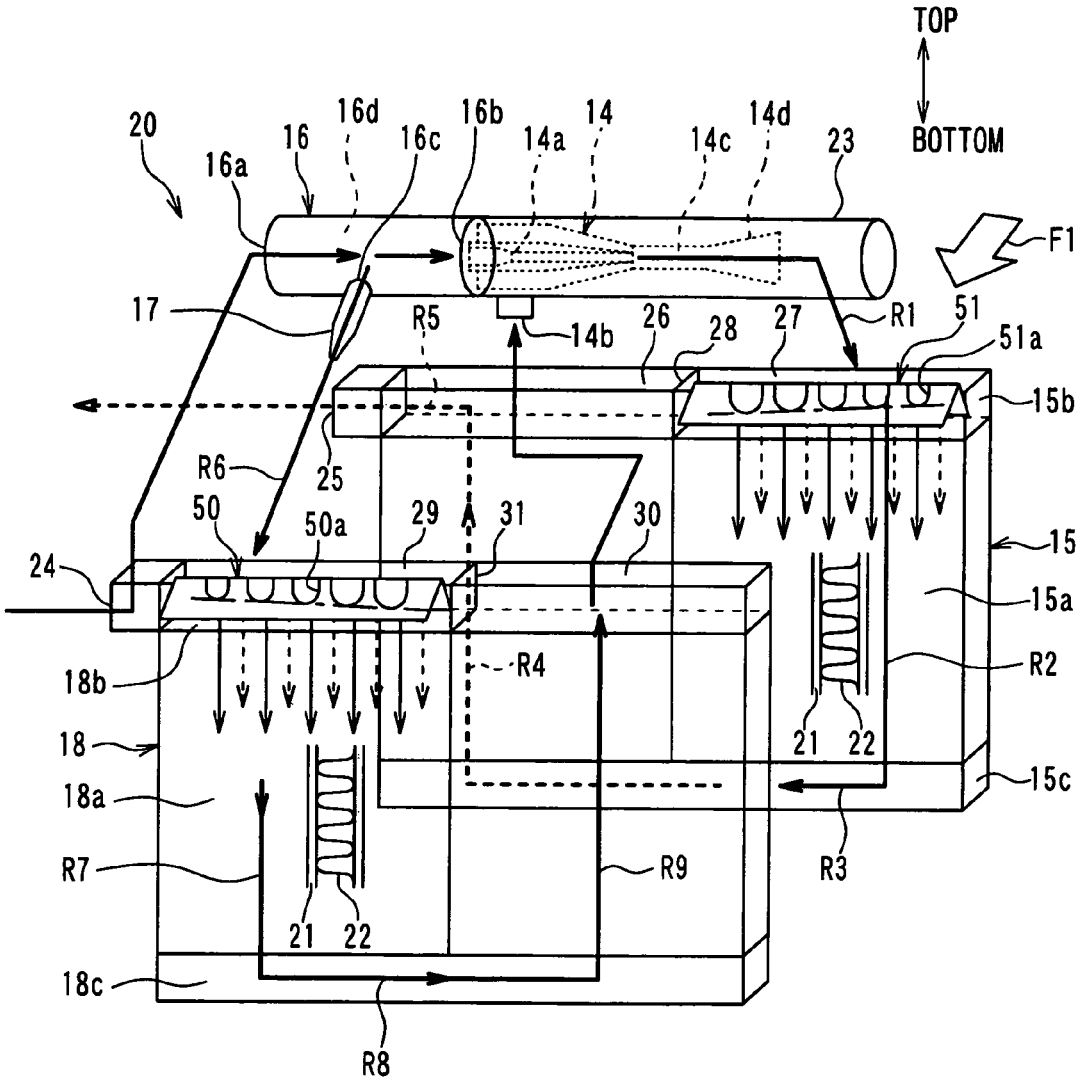
FIG. 11 is a disassembled perspective view showing a schematic structure of an evaporator unit for a refrigerant cycle device according to a seventh embodiment of the present invention.

A seventh embodiment of the present invention will be described with reference to FIG. 11. In the seventh embodiment, as shown in FIG. 11, a refrigerant storage member 50 is provided in the first tank space 29 of the upper tank 18*b* of the second evaporator 18 so as to improve the distribution performance of the refrigerant distributed into the plural tubes 21, and a refrigerant storage member 51 is provided in the second tank space 27 of the upper tank 15*b* of the first evaporator 15 so as to improve the distribution performance of the refrigerant distributed into the plural tubes 21. The second tank space 27 of the upper tank 15*b* of the first evaporator 15 is adapted as a first refrigerant distribution tank portion, and the first tank space 29 of the upper tank 18*b* of the second evaporator 18 is adapted as a second refrigerant distribution tank portion, in the integrated evaporator unit 20.

The refrigerant storage member 50 is located in the first tank space 29 of the upper tank 18*b* of the second evaporator 18, and is formed into a mountain-fold shape having a mountain top (fold line) extending in the axial direction and two rectangular plates at two sides of the mountain top. The refrigerant storage member 50 is located in the first tank space 29 of the upper tank 18*b* of the second evaporator 18 such that the fold line corresponds to the longitudinal direction of the first tank space 29 of the upper tank 18*b*, and is protruded to a side opposite to the tubes 21.

Figure 12A:
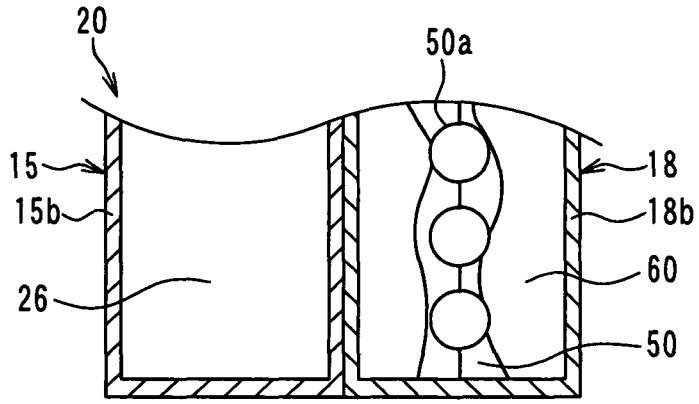
FIG. 12A is a cross sectional view showing a part of a tank portion of the evaporator unit of FIG. 11.
Figure 12B:
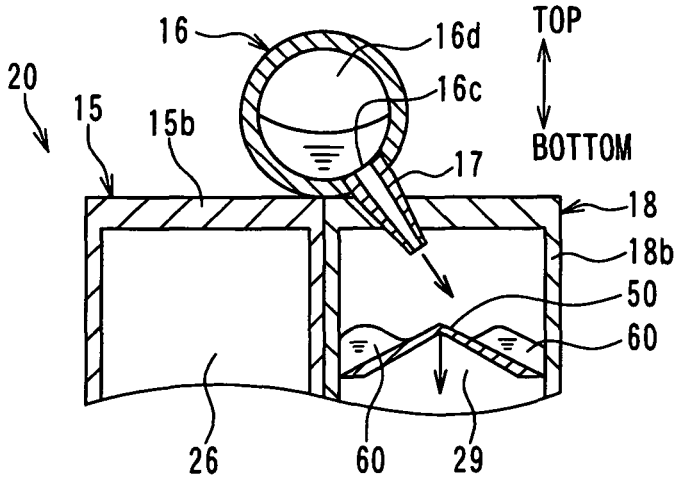
FIG. 12B is a cross-sectional view showing a part of the tank portion with a flow amount distributor, according to the seventh embodiment.

As shown in FIG. 12B, two lower end portions of the refrigerant storage member 50 is brazed to the inner surface of the upper tank 18*b* defining the first tank space 29. The refrigerant decompressed in the throttle mechanism 17 flows into the upper space of the refrigerant storage member 50 within the second tank space 29, and liquid refrigerant 60 is stored at two lower end portions of the refrigerant storage member 50 within the second tank space 29 used as the refrigerant distribution tank portion of the second evaporator 18.

As shown in FIG. 12A, a plurality of hole portions 50*a* are provided in a top portion of the refrigerant storage member 50. When the refrigerant 60 stored at the lower end portions of the refrigerant storage member 50 is increased and reaches to the hole portions 50*a*, the refrigerant overflows from the hole portions 50*a* of the refrigerant storage member 50 to fall toward the tubes 21, thereby flowing through the tubes 21. The plural hole portions 50*a* are arranged in the top portion of the refrigerant storage member 50, in the tank longitudinal direction. In FIG. 11, a virtual line of the bottoms of the hole portions 50*a* is indicated by a chain line. As shown in FIG. 11, the holes portions 50*a* are provided in the refrigerant storage member 50 such that the open areas of the hole portions 50*a* becomes smaller as toward the refrigerant inlet portion of the first tank space 29 used as the refrigerant distribution tank portion of the second evaporator 18.

The refrigerant storage member 51 located in the first tank space 27 of the upper tank 15*b*, used as the refrigerant distribution tank portion of the first evaporator 15, has a structure similar to the refrigerant storage member 50 located in the first tank space 29 used as the refrigerant distribution tank portion of the second evaporator 18. The refrigerant storage member 51 is formed into a mountain-fold shape having a mountain top (fold line) extending in the axial direction and two rectangular plates at two sides of the mountain top. The refrigerant storage member 51 is located in the second tank space 27 of the upper tank 15*b* of the first evaporator 15 such that the fold line corresponds to the longitudinal direction of the second tank space 27 of the upper tank 15*b*, and is protruded to a side opposite to the tubes 21. Furthermore, two lower end portions of the refrigerant storage member 51 is brazed to the inner surface of the upper tank 15*b* defining the second tank space 27 used as the refrigerant distribution tank portion of the first evaporator 15.

The refrigerant from the diffuser portion 14*d* of the ejector 15 flows into the upper space of the refrigerant storage member 51 within the second tank space 27, and liquid refrigerant is stored at two lower end portions of the refrigerant storage member 51 within the second tank space 27 used as the refrigerant distribution tank portion of the first evaporator 15.

A plurality of hole portions 51*a* are provided in a top portion of the refrigerant storage member 51. When the refrigerant stored at the lower end portions of the refrigerant storage member 51 is increased and reaches to the hole portions 51*a*, the refrigerant overflows from the hole portions 51*a* to fall toward the tubes 21, thereby flowing through the tubes 21. The plural hole portions 51*a* are arranged in the top portion of the refrigerant storage member 51, in the tank longitudinal direction. In FIG. 11, a virtual line of the bottoms of the hole portions 51*a* is indicated by a chain line. As shown in FIG. 11, the holes portions 51*a* are provided in the refrigerant storage member 51 such that the open areas of the hole portions 51*a* becomes smaller as toward the refrigerant inlet portion of the second tank space 27 used as the refrigerant distribution tank portion of the first evaporator 15.

In the present embodiment, because the refrigerant distribution members 50, 51 are provided respectively in the first and second refrigerant distribution tank portions (27, 29) of the first evaporator 15 and the second evaporator 18, the distribution performance of the refrigerant flowing into the plural tubes 21 is improved, thereby making the temperature distribution to be uniform.

In the present embodiment, the refrigerant storage members 50, 51 are provided, respectively, in both the tank spaces 27, 29 used as the first and second refrigerant distribution tank portions of the first and second evaporators 15, 18. However, any one of the refrigerant storage members 50, 51 may be provided in the corresponding one of the tank spaces 27, 29 used as the first and second refrigerant distribution tank portions of the first and second evaporators 15, 18.

Figure 13A:
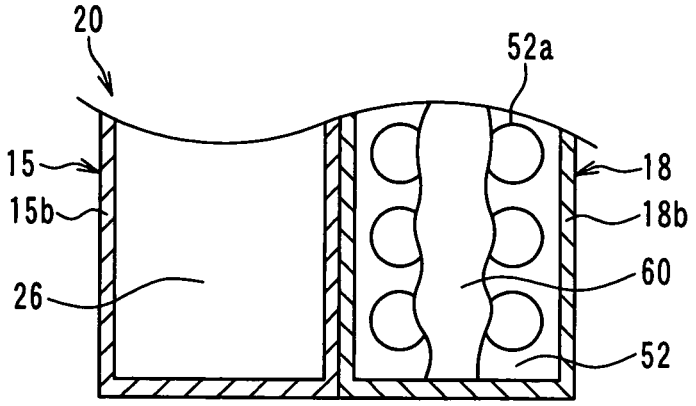
FIG. 13A is a cross sectional view showing a part of a tank portion for an evaporator unit.
Figure 13B:
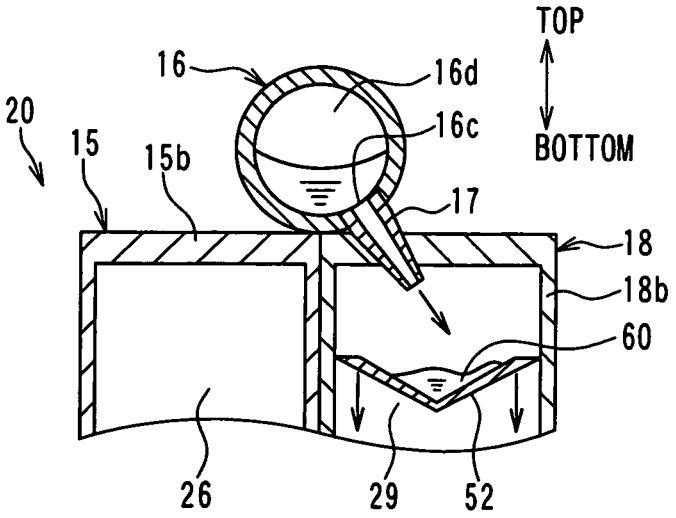
FIG. 13B is a cross-sectional view showing a part of the tank portion with a flow amount distributor, according to a first modification example of the seventh embodiment.

FIGS. 13A to 16B show modification examples of the refrigerant storage members 50, 51, according to the seventh embodiment. FIGS. 13A and 13B show a refrigerant storage member 52 that is a first modification example of the seventh embodiment of the present invention. As shown in FIGS. 13A and 13B, the refrigerant storage member 52 is disposed in the first tank space 29 adapted as the refrigerant distribution tank portion reversely from the refrigerant storage tank member 50, 51 in the top-bottom direction. Therefore, the refrigerant storage member 52 has a valley fold shape having two rectangular plates at two sides of the valley line. In this case, a plurality of hole portions 52*a* are formed in tilt surfaces of the refrigerant storage member 52.

When the refrigerant storage member 52 of the first modification example is used in the refrigerant distribution tank portion of the first or second evaporator 15, 18, the liquid refrigerant stores once in a valley portion of the refrigerant storage member 52. Then, when the refrigerant stored at the valley portion of the refrigerant storage member 52 is increased and reaches to the hole portions 52*a*, the refrigerant overflows from the hole portions 52*a* to fall toward the tubes 21, thereby flowing through the tubes 21. Instead of the plural hole portions 52*a*, cut portions each of which is cut in a minor direction of the refrigerant storage member 52 may be provided in the refrigerant storage member 52.

Figure 14A:
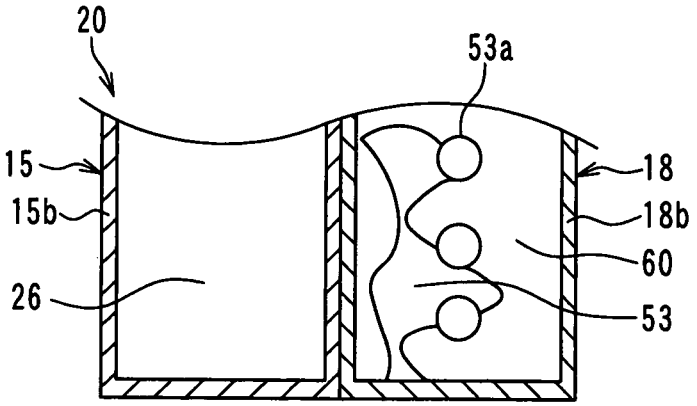
FIG. 14A is a cross sectional view showing a part of a tank portion for an evaporator unit.
Figure 14B:
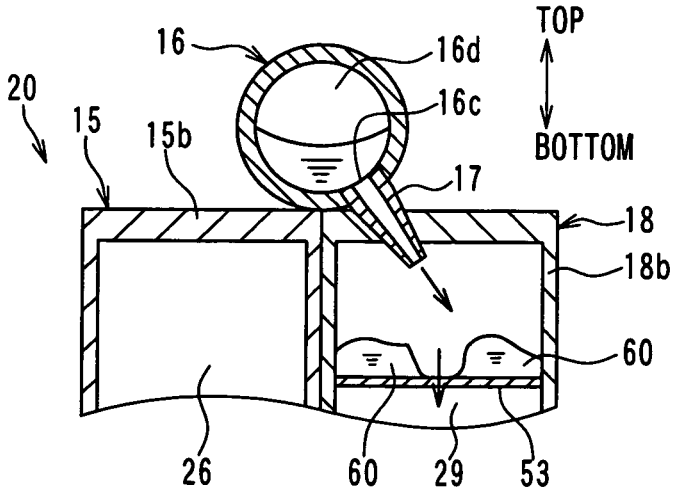
FIG. 14B is a cross-sectional view showing a part of the tank portion with a flow amount distributor, according to a second modification example of the seventh embodiment.

FIGS. 14A and 14B show a refrigerant storage member 53 that is a second modification example of the seventh embodiment of the present invention. As shown in FIGS. 14A and 14B, the refrigerant storage member 53 is a flat rectangular plate having plural hole portions 53*a* arranged in a major direction of the refrigerant storage member 53, corresponding to the tank longitudinal direction of the refrigerant distribution tank portion. Each of the plural hole portions 53*a* is located at a center area in the refrigerant storage member 53 in a minor direction of the refrigerant storage member 53. The minor direction is perpendicular to the major direction in the refrigerant storage member 53.

When the refrigerant storage member 53 of the second modification example of the seventh embodiment is used in the refrigerant distribution tank portion of the first or second evaporator 15, 18, the liquid refrigerant stores once on the upper surface of the refrigerant storage member 53, and then falls toward the tubes 21, thereby flowing through the tubes 21.

Figure 15A:
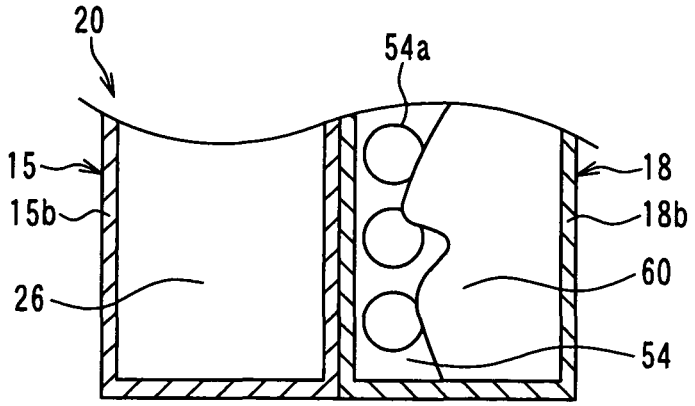
FIG. 15A is a cross sectional view showing a part of a tank portion for an evaporator unit.
Figure 15B:
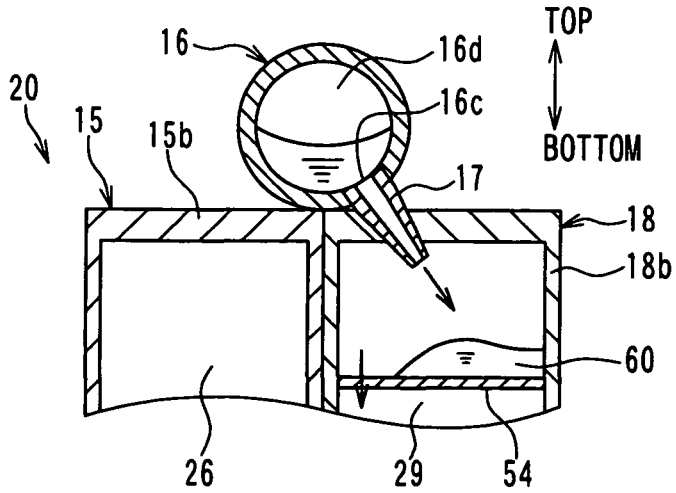
FIG. 15B is a cross-sectional view showing a part of the tank portion with a flow amount distributor, according to a third modification example of the seventh embodiment.

FIGS. 15A and 15B show a refrigerant storage member 54 that is a third modification example of the seventh embodiment of the present invention. As shown in FIGS. 15A and 15B, the refrigerant storage member 54 is a flat rectangular plate having plural hole portions 54*a* arranged in a major direction of the refrigerant storage member 54, corresponding to the tank longitudinal direction of the refrigerant distribution tank portion. Each of the plural hole portions 54*a* is located at an end portion in the refrigerant storage member 54 in a minor direction of the refrigerant storage member 54. The minor direction is perpendicular to the major direction in the refrigerant storage member 54.

When the refrigerant storage member 54 of the third modification example of the seventh embodiment is used in the refrigerant distribution tank portion of the first or second evaporator 15, 18, the liquid refrigerant stores once on the upper surface of the refrigerant storage member 54, and then falls toward the tubes 21, thereby flowing through the tubes 21. Instead of the plural hole portions 54*a*, cut portions each of which is cut at the end portion of the refrigerant storage member 54 in the minor direction may be formed.

Figure 16A:
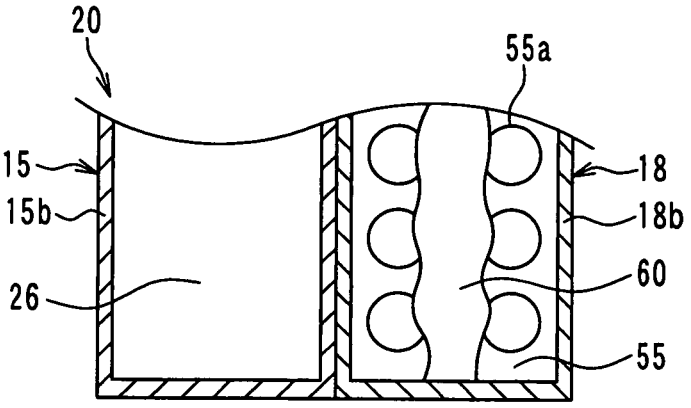
FIG. 16A is a cross sectional view showing a part of a tank portion for an evaporator unit.
Figure 16B:
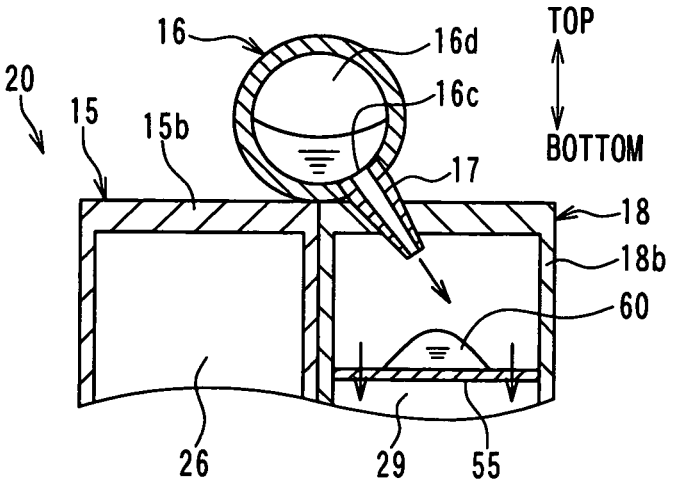
FIG. 16B is a cross-sectional view showing a part of the tank portion with a flow amount distributor, according to a fourth modification example of the seventh embodiment.

FIGS. 16A and 16B show a refrigerant storage member 55 that is a fourth modification example of the seventh embodiment of the present invention. As shown in FIGS. 16A and 16B, the refrigerant storage member 55 is a flat rectangular plate having plural hole portions 55*a* arranged in two lines in a major direction of the refrigerant storage member 55, corresponding to the tank longitudinal direction of the refrigerant distribution tank portion. The two lines of the plural hole portions 55*a* are arranged at two end portions in the refrigerant storage member 55 in a minor direction of the refrigerant storage member 55. The minor direction is perpendicular to the major direction in the refrigerant storage member 55.

When the refrigerant storage member 55 of the fourth modification example of the seventh embodiment is used in the refrigerant distribution tank portion of the first or second evaporator 15, 18, the liquid refrigerant stores once on the upper surface of the refrigerant storage member 55, and then falls toward the tubes 21, thereby flowing through the tubes 21. Instead of the plural hole portions 55*a*, cut portions each of which is cut at the end portions of the refrigerant storage member 55 in the minor direction may be formed.

In the seventh embodiment and modifications thereof, the other parts of the integrated evaporator unit 20 may be similar to those of the above-described first embodiment.

Eighth Embodiment

An eighth embodiment and modification examples of the present invention will be described with reference to FIGS. 17A to 19. In the above-described first embodiment, the throttle mechanism 17 is provided outside of the flow amount distributor 16. However, in the eighth embodiment and modification examples of the eighth embodiment, the throttle mechanism 17 is provided inside the flow amount distributor 16.

Figures 17A, 17B:
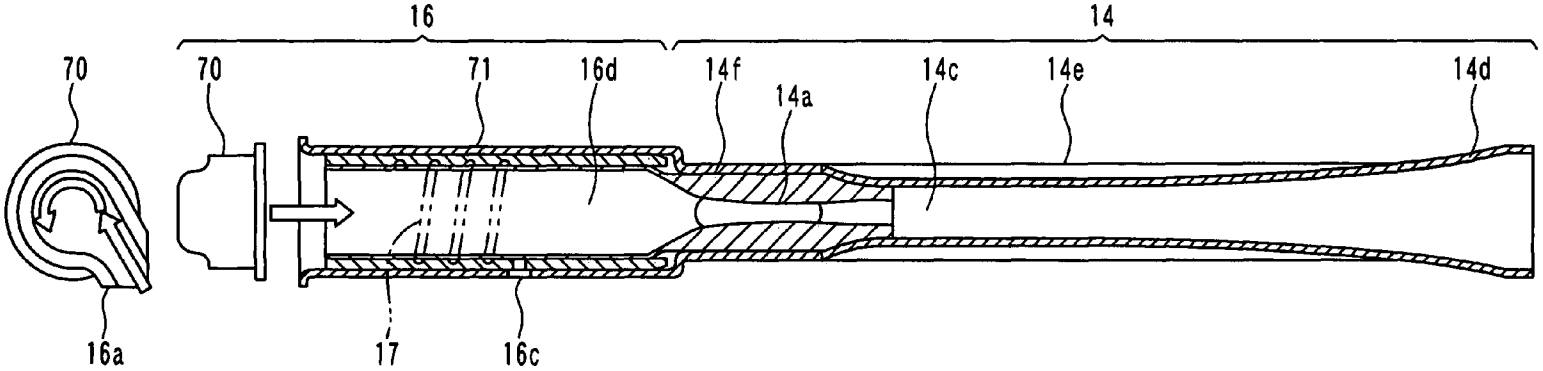
FIGS. 17A and 17B are cross-sectional views showing an ejector integrated with a flow amount distributor, according to an eighth embodiment of the present invention.

As shown in FIGS. 17A and 17B, the flow amount distributor 16 is provided with a swirl generating portion 70 configured to generate a swirl movement to the refrigerant flowing from the inlet port 16*a*, and a body portion 71 defining therein the cylindrical space 16*d* in which the refrigerant with the generated swirl movement flows.

The body portion 71 is adapted as a gas-liquid separation portion for separating the refrigerant into gas refrigerant and the liquid refrigerant, as well as is also adapted as a refrigerant distribution portion for distributing the separated refrigerant to the nozzle portion 14*a* and the second evaporator 18. The body portion 71 is a cylinder having approximately constant diameter, and is provided coaxially with the ejector 14, as shown in FIG. 17B In the example of FIGS. 17A and 17B, the swirl generating portion 70 is a cap member configured to cover one end portion of the cylindrical body portion 71. Thus, the swirl generating portion 70 can be formed separately from the cylindrical body portion 71. FIG. 17B shows a disassemble state of the cylindrical body portion 71 and the swirl generating portion 70 that is adapted as the cap member of the cylindrical body portion 71.

Figure 18:
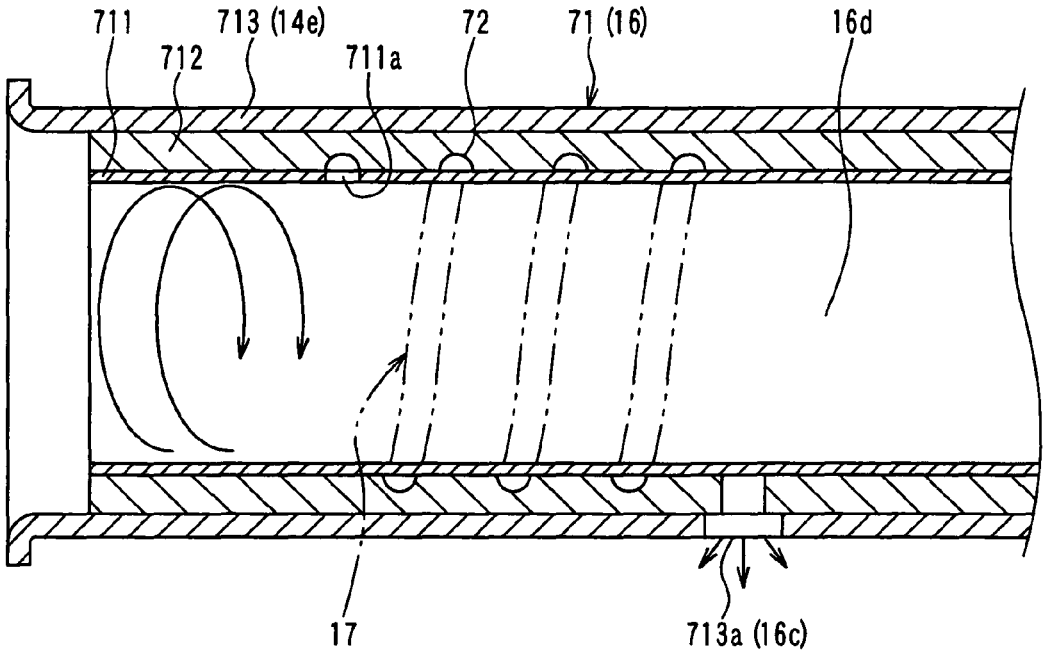
FIG. 18 is an enlarged sectional view showing the flow amount distributor shown in FIGS. 17A and 17B.

As shown in FIG. 18, the cylindrical body portion 71 is configured by a three-layer structure, in which an inner cylinder 711, a middle cylinder 712 and an outer cylinder 713 are overlapped with each other in the radial direction. The inner cylinder 711 is molded integrally with the nozzle portion 14*a* of the ejector 14, and the outer cylinder 13 is molded integrally with a body member 14*e* of the ejector 14.

As shown in FIG. 17B, the body portion 14*e* of the ejector 14 is a member for forming the mixing portion 14*c* and the diffuser portion 14*d* of the ejector 14. A nozzle forming member 14*f* is accommodated in the body member 14*e*, so as to form the nozzle portion 14*a* of the ejector 14.

As shown in FIG. 18, the throttle mechanism 17 is formed into a helical capillary tube between the inner cylinder 711 and the middle cylinder 712. Specifically, a helical groove is formed to be recessed from the inner wall surface of the middle cylinder 712, thereby form a helical capillary passage 72 between the inner cylinder 711 and the middle cylinder 712. The helical capillary passage 72 is adapted as a capillary tube for decompressing the refrigerant, and the throttle mechanism 17 is configured by using the helical capillary passage 72.

An inlet hole 711*a* communicating with the helical capillary passage 72 is provided in the inner cylinder 711, and is used as a capillary inlet port from which the refrigerant is introduced into the helical capillary passage 72. An outlet hole 713*a* communicating with the helical capillary passage 72 is proved in the outer cylinder 713, and is used as a capillary outlet port from which the refrigerant having passed through the helical capillary passage 72 flows out. In this example of FIG. 18, the hole 713*a* is also adapted as the second outlet port 16*c* of the flow amount distributor 16, so that the refrigerant flowing out of the hole 713*a* flows into the upper tank 18*b* of the second evaporator 18.

The refrigerant flowing from the inlet port 16*a* of the flow amount distributor 16 flows in the swirl generating portion 70 so that a swirl movement will be generated in the refrigerant, and then flows in the cylindrical space 16*d* of the body portion 71 while being swirled. The refrigerant flowing in the cylindrical space 16*d* of the body portion 71 is separated into gas refrigerant on the radial center side of the cylindrical space 16*d*, and liquid refrigerant on the radial outer side of the cylindrical space 16*d*, by using the centrifugal force of the swirl flow.

The separated liquid refrigerant flows while being swirled along the inner wall surface of the cylindrical body portion 71, and flows into the capillary passage 72 from the capillary inlet hole 711*a*. The refrigerant having been decompressed in the capillary passage 72 flows into a refrigerant distribution tank portion of the upper tank 18*b* of the second evaporator 18 from the capillary outlet hole 713*a*.

According to the present embodiment, because the throttle mechanism 17 is configured by the helical capillary passage 72, it is possible to reduce the variation in the refrigerant flow amount with respect to the variation in the refrigerant dryness at the inlet side of the throttle mechanism 17, as in the arrow C1 of FIG. 5B.

In contrast, the throttle mechanism 17 is formed into the capillary tube, and thereby the ratio (L/D) of the entire length (L) of the throttle mechanism 17 to the inner diameter (D) becomes larger. However, in the present embodiment, because the throttle mechanism 17 is configured by the helical capillary passage 72 provided in the flow amount distributor 16, the entire size of the integrated evaporator unit 20 can be made small.

Figure 19:
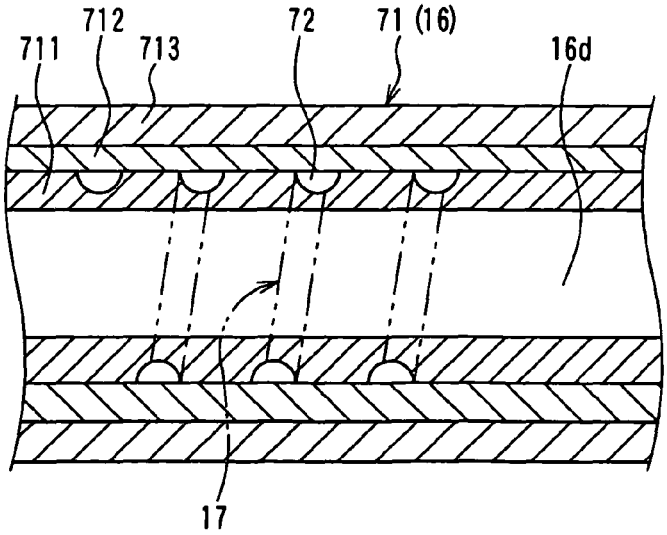
FIG. 19 is a cross-sectional view showing a flow amount distributor according to a modification example of the eighth embodiment.

FIG. 19 shows a modification example of the eighth embodiment of the present invention. In the example of FIG. 19, a helical capillary passage 72 is provided on the outer wall surface of the inner cylinder 711, thereby forming the throttle mechanism 17.

In the eighth embodiment and the modification example thereof, the other parts of the integrated evaporator unit 20 may be similar to those of the above-described first embodiment.

Ninth Embodiment

A ninth embodiment of the present invention will be described with reference to FIGS. 20A and 20B. In the above-described eighth embodiment, the cylindrical body portion 71 of the flow amount distributor 16 is configured by the three-layer structure. However, in the ninth embodiment, the cylindrical body portion 71 is configured by a double-layer structure in which an inner cylinder 711 and an outer cylinder 713 are overlapped with each other in the radial direction, as shown in FIGS. 20A and 20B.

Figure 20A:
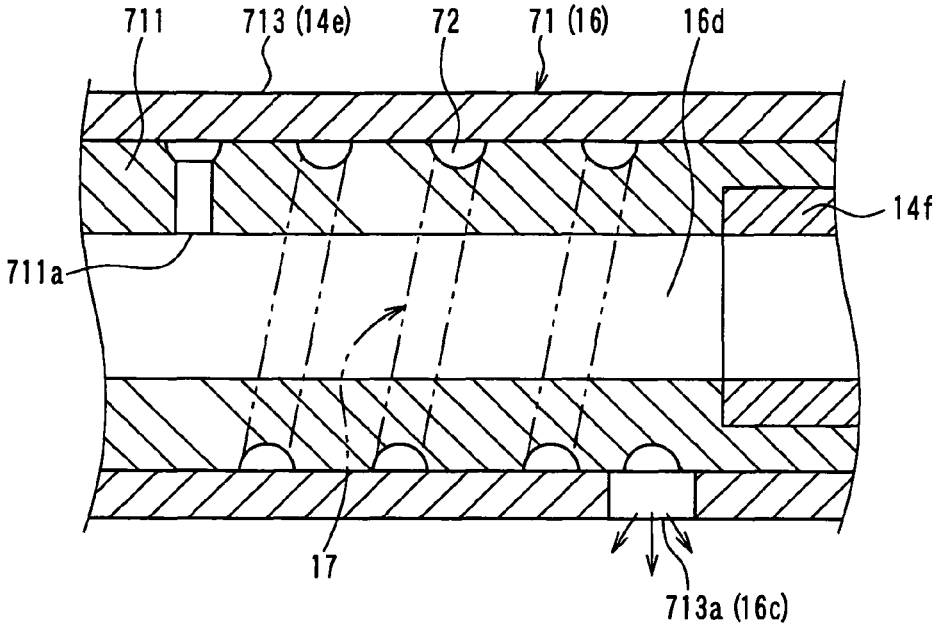
FIGS. 20A and 20B are cross-sectional views showing examples of a flow amount distributor according to a ninth embodiment of the present invention.

FIG. 20A shows an example of the cylindrical body portion 71, in which the inner cylinder 711 is molded separately from the nozzle forming member 14*f* of the ejector 14, and the nozzle forming member 14*f* is fitted into the inner cylinder 711. In the cylindrical body portion 71 of FIG. 20A, the outer cylinder 713 is molded integrally with the body member 14*e* of the ejector 14. A helical groove is formed on the outer wall surface of the inner cylinder 711 to be recessed from the outer wall surface of the inner cylinder 711, so as to form a helical capillary passage 72 between the inner cylinder 711 and the outer cylinder 713.

Figure 20B:
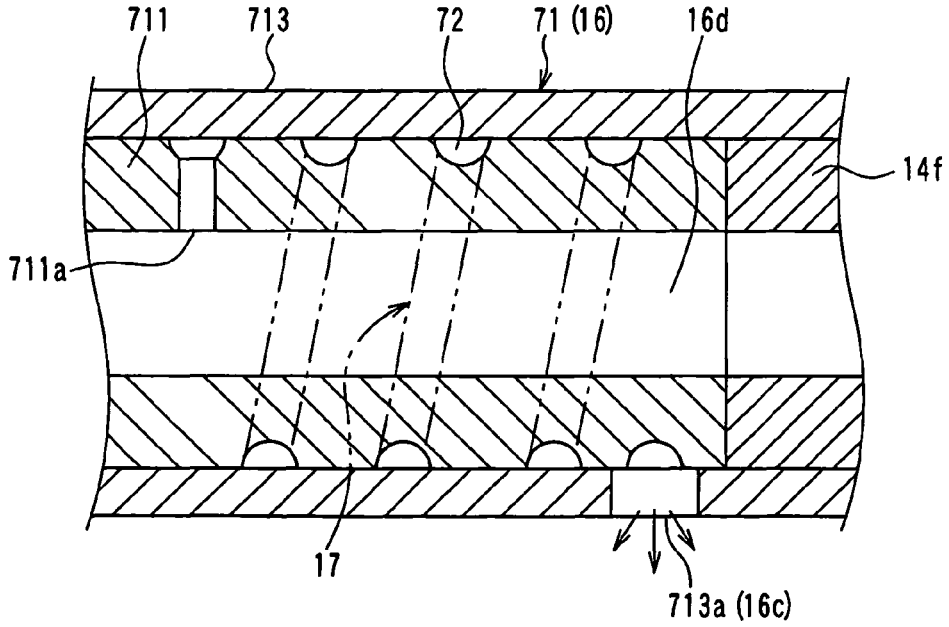

FIG. 20B shows another example of the cylindrical body portion 71, in which the nozzle forming member 14*f* has an outer diameter approximately equal to the inner diameter of the outer cylinder 713, and the nozzle forming member 14*f* is fitted into the outer cylinder 713. In the example of FIG. 20B, the inner cylinder 711 may be molded integrally with the nozzle forming member 14*f*, or may be molded separately from the nozzle forming member 14*f*.

In the ninth embodiment, because the throttle mechanism 17 configured by the helical capillary passage 72 is provided in the flow amount distributor 16, the same effects described in the eighth embodiment can be obtained. In addition, because the cylindrical body portion 71 is configured by the double-layer structure, and the helical capillary passage 72 is provided between the inner cylinder 711 and the outer cylinder 713, the helical capillary passage 72 can be easily formed in the cylindrical body portion 71. A helical groove may be provided in the inner wall surface of the outer cylinder 713 so as to form the helical capillary passage 72 between the inner cylinder 711 and the outer cylinder 713.

When the inner cylinder 711 is molded separately from the nozzle forming member 14*f*, the molding length of the nozzle forming member 14*f* can be made shorter, thereby easily accurately forming the nozzle forming member 14*f*.

In the ninth embodiment, the other parts of the integrated evaporator unit 20 may be similar to those of the above-described eighth embodiment.

Tenth Embodiment

A tenth embodiment of the present invention will be described with, reference to FIG. 21. In the above-described ninth embodiment, the single helical capillary passage 72 is provided between the inner cylinder 711 and the outer cylinder 713. In the tenth embodiment, as shown in FIG. 21, plural capillary passages 72 are formed between the inner cylinder 711 and the outer cylinder 713.

Figure 21:
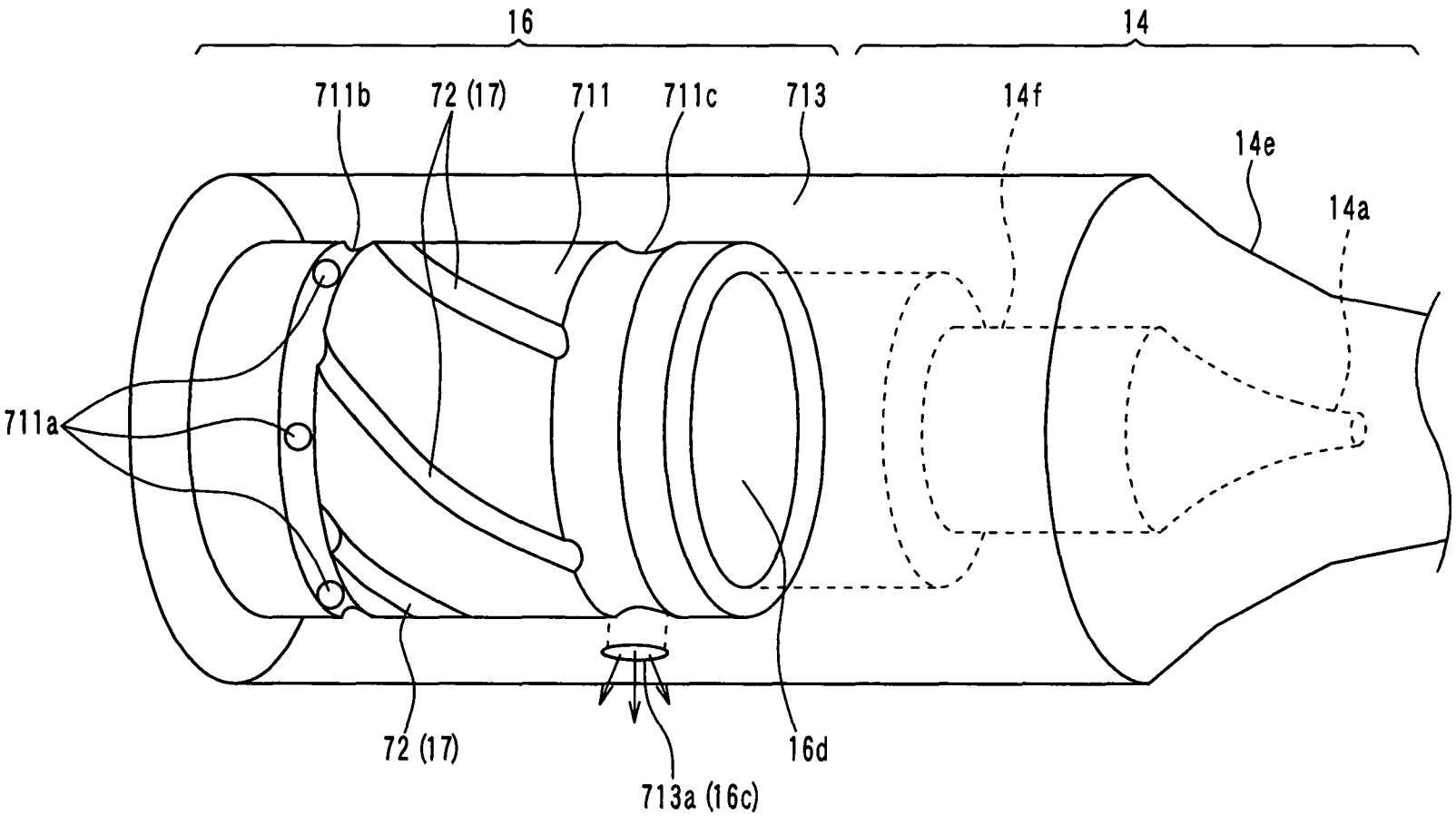
FIG. 21 is a perspective view showing a part of an ejector and a flow amount distributor integrated with the ejector, according to a tenth embodiment of the present invention.

In the example of FIG. 21, inlet sides of the plural capillary passages 72 are connected to a circular groove 711*b* provided along an entire circular periphery of the inner cylinder 711, and outlet sides of the plural capillary passages 72 are connected to a circular groove 711*c* provided along an entire circular periphery of the inner cylinder 711. A plurality of inlet holes 711*a* are provided in the circular groove 711*b* of the inner cylinder 711 to be arranged in the circumferential direction of the inner cylinder 711.

In the present embodiment, the plural capillary passages 72 are provided respectively separately, and are extended approximately in parallel. Thus, it is possible to reduce the length of each of the capillary passages 72, thereby shorten the entire length of the body portion 71 of the flow amount distributor 16. Furthermore, because the length of each capillary passage 72 can be made short, the capillary passage 72 can be formed approximately straightly based on the numbers of the capillary passages 72 and the length of each capillary passage 72, without being limited to the helical shape.

Furthermore, even when one of the capillary passages 72 is blocked by a foreign material or the like to deteriorate the refrigerant flow, because the refrigerant can flows through the other capillary passages 72, the decompression of the refrigerant can be substantially obtained without being affected by the blocked capillary passage 72.

In the present embodiment, the outlet sides of the capillary passages 72 are connected to the single circular groove 711*c* extending along the entire periphery of the inner cylinder 711, thereby easily fitting the position with the outlet hole 713*a* provided in the outer cylinder 713.

In the present embodiment, by suitably setting the number of the capillary passages 72, the ratio (Ge/Gn) of the flow amount Ge of the refrigerant flowing into the refrigerant suction port 14*b* of the ejector 14 via the second evaporator 18 to the flow amount Gn of the refrigerant flowing into the nozzle portion 14*a* of the ejector 14 can be suitably controlled.

Because the plural inlet holes 711*a* are provided in the circular groove 711*b* at plural positions in the circumferential direction, the refrigerant from the swirl generating portion 70 can be introduced into the capillary passages 72 in uniform.

Thus, a liquid film of the liquid refrigerant flowing along the outer wall surface of the inner cylinder 711 can be made thinner entirely, thereby preventing a meandering flow of gas refrigerant due to the different of the thickness of the liquid film, when the liquid refrigerant flows through the capillary passages 72. Therefore, the ratio (Ge/Gn) of the flow amount Ge of the refrigerant flowing into the refrigerant suction port 14*b* of the ejector 14 to the flow amount Gn of the refrigerant flowing into the nozzle portion 14*a* of the ejector 14 can be increased.

Eleventh Embodiment

Figure 22B:
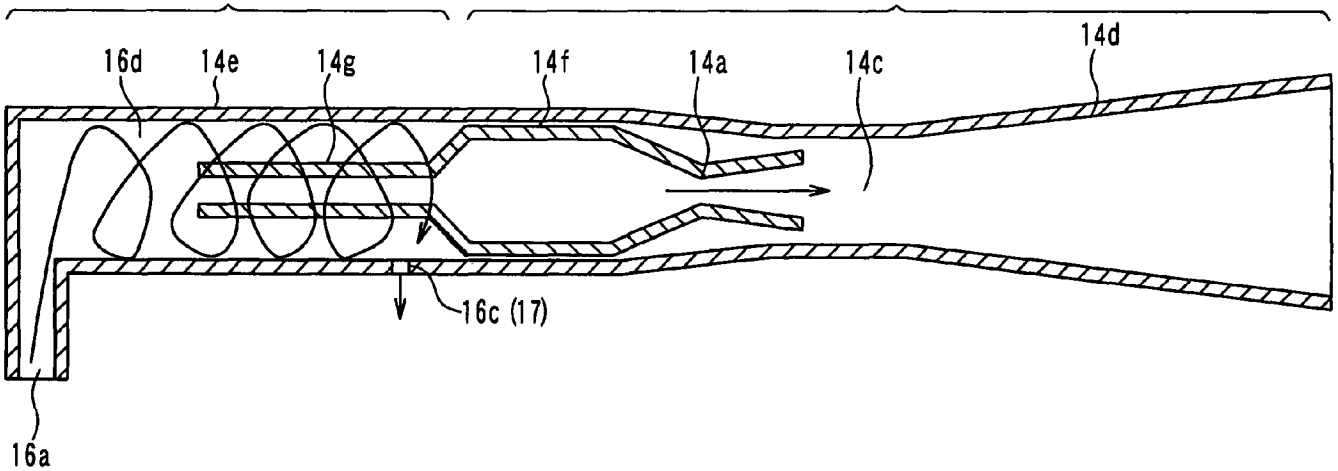
FIGS. 22A and 22B are cross-sectional views showing an ejector and a flow amount distributor provided in the ejector, according to an eleventh embodiment of the present invention.
Figure 22A:
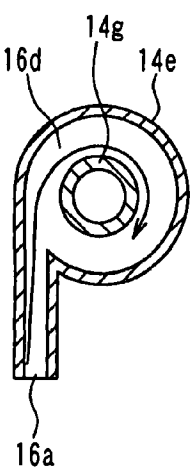

An eleventh embodiment of the present invention will be described with reference to FIGS. 22A and 22B. In the eleventh embodiment, as shown in FIG. 22B, the flow amount distributor 16 is formed integrally with the ejector 14.

Specifically, a cylindrical outer cell of the flow amount distributor 16 is formed by a body member 14*e* of the ejector 14, and a pipe portion 14*g* is formed integrally with a nozzle forming member 14*f* at the inlet side of the nozzle forming member 14*f*. An inlet port 16*a* and an outlet port 16*c* of the flow amount distributor 16 are provided in a cylindrical wall surface of the body member 14*e*. The outlet port 16*c* is formed in an orifice shape or a nozzle shape so as to be adapted as the throttle mechanism 17.

The gas-liquid refrigerant flowing from the inlet port 16*a* is separated into gas refrigerant and liquid refrigerant in the flow amount distributor 16 by using a centrifugal force of the swirl flow. Similarly to the fourth embodiment, a swirl generating portion is provided at an inlet side of the flow amount distributor 16 so that a swirl movement is applied to the refrigerant flowing in the cylindrical body portion 14*e*. As a result, a gas-rich refrigerant flows in the cylindrical space 16*d* of the flow amount distributor 16 at a radial center side of the body member 14*e*, and is introduced into the nozzle portion 14*a* of the nozzle forming member 14*f* via the pipe portion 14*g* of the nozzle forming member 14*f*.

On the other hand, a liquid-rich refrigerant flows in the cylindrical space 16*d* of the flow amount distributor 16 while being swirled along the inner peripheral surface of the body member 14*e*, and is introduced into the refrigerant distribution tank portion of the upper tank 18*b* of the second evaporator 18 from the outlet port 16*c* provided in the cylindrical wall surface of the body member 14*e*.

Thus, the pipe portion 14*g* can be adapted as a partition wall for partitioning the gas-rich refrigerant and the liquid-rich refrigerant; thereby easily separating the gas-rich refrigerant and the liquid-rich refrigerant from each other.

In the present embodiment, the pipe portion 14*g* is provided at the inlet side portion of the nozzle forming member 14*f* so that the flow amount distributor 16 is formed integrally with the ejector 14. Therefore, the integrated structure between the ejector 14 and the flow amount distributor 16 can be easily formed. Further the throttle mechanism 17 is formed integrally with the ejector 14 by simply forming the outlet port 16*c* in the cylindrical wall surface of the body member 14*e*.

In the eleventh embodiment, the other parts of an integrated evaporator unit 20 may be similar to those of the above-described first embodiment.

Twelfth Embodiment

A twelfth embodiment of the present invention will be described with reference to FIGS. 23A and 24D. In the above-described eleventh embodiment, the integrated member of the flow amount distributor 16 and the ejector 14 is configured such that the refrigerant flows while being swirled in the body member 14*e* of the ejector 14. However; in the twelfth embodiment, as shown in FIGS. 23A and 23B, the flow amount distributor 16 is configured by the nozzle forming member 14*f* such that the refrigerant flows in the flow amount distributor 16 while being swirled in the nozzle forming member 14*f* of the ejector 14.

Figure 23A:
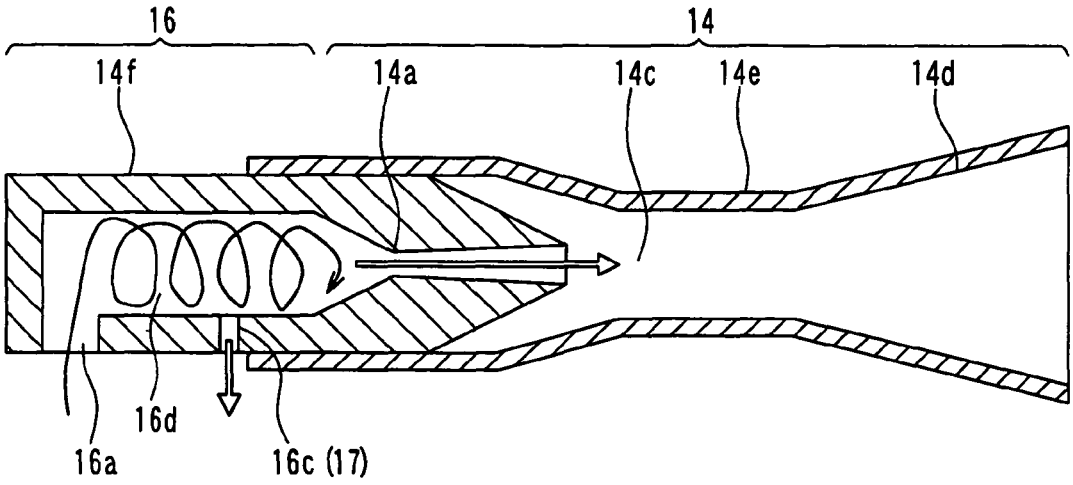
FIGS. 23A and 23B are cross-sectional views each showing an ejector and a flow amount distributor provided in the ejector, according to a twelfth embodiment of the present invention.
Figure 23B:
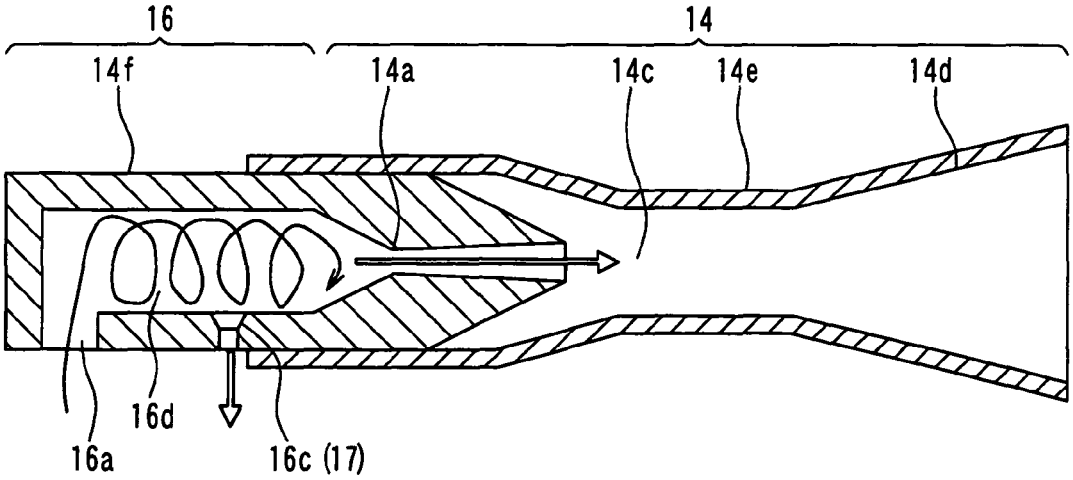

As shown in FIGS. 23A and 23B, an inlet side portion of the nozzle forming member 14*f* is made to protrude from the body member 14*e*, and an inlet port 16*a* and an outlet port 16*c* are provided in a cylindrical wall surface of the protruded nozzle forming member 14*f*.

FIG. 23A shows an example in which the outlet port 16*c* adapted as the throttle mechanism 17 is an orifice, and FIG. 23B shows an example in which the outlet port 16*c* adapted as the throttle mechanism 17 is formed into a nozzle shape.

The gas-liquid refrigerant flowing from the inlet port 16*a* is separated into gas refrigerant and liquid refrigerant in the flow amount distributor 16 by using a centrifugal force of the swirl flow. As a result, a gas-rich refrigerant flows in the nozzle forming member 14*f* in a portion used as the flow amount distributor 16 at a radial center side of the nozzle forming member 14*f*, is introduced into the nozzle portion 14*a* of the nozzle forming member 14*f*, and is jetted into the mixing portion 14*c* of the ejector 14 from the refrigerant jet port of the nozzle portion 14*a*.

On the other hand, a liquid-rich refrigerant flows in the nozzle forming member 14*f* in a portion adapted as the flow amount distributor 16 while being swirled along the inner peripheral surface of the nozzle forming member 14*f*, and is introduced into the refrigerant distribution tank portion of the upper tank 18*b* of the second evaporator 18 via the outlet port 16*c* provided in the cylindrical wall surface of the protruded nozzle forming member 14*f*.

According to the present embodiment, because the flow amount distributor 16 is configured in the nozzle forming member 14*f* without using a pipe member, the integrated structure of the flow amount distributor 16 and the ejector 14 can be easily formed.

Figure 24B:
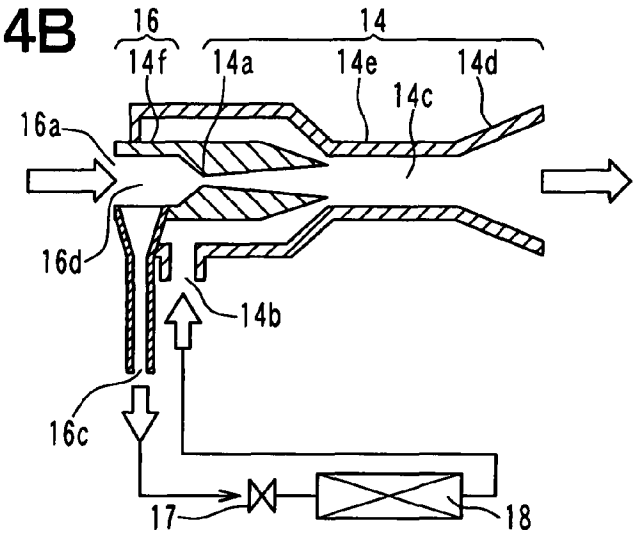
FIGS. 24A to 24D are schematic diagrams showing examples of a refrigerant cycle device with an ejector and a flow amount distributor provided in the ejector, according to the twelfth embodiment.
Figure 24A:
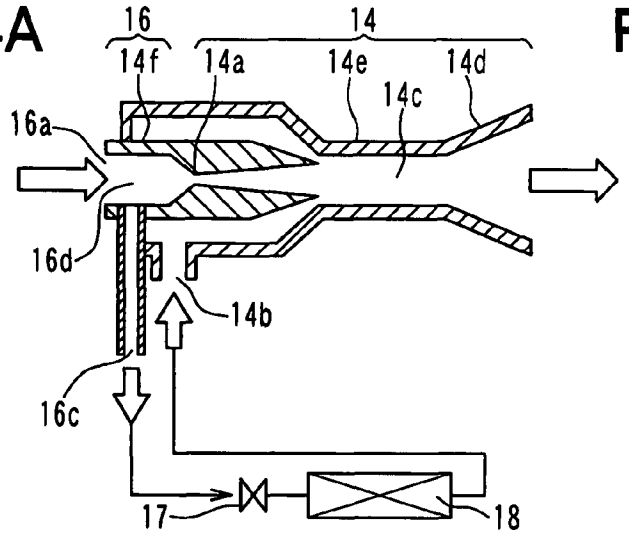
Figure 24D:
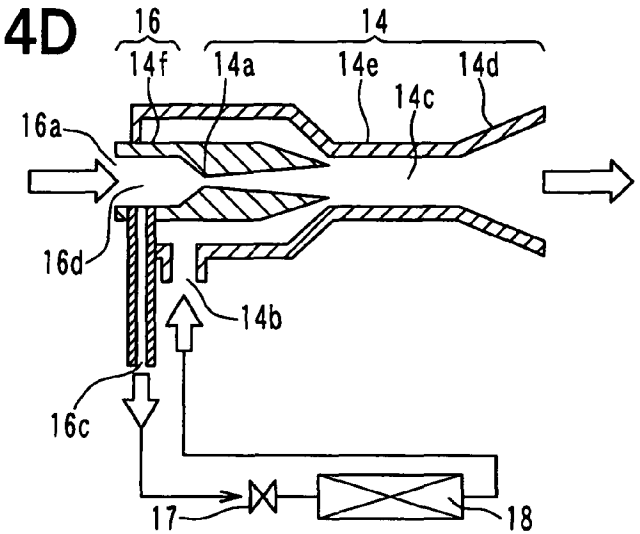
Figure 24C:
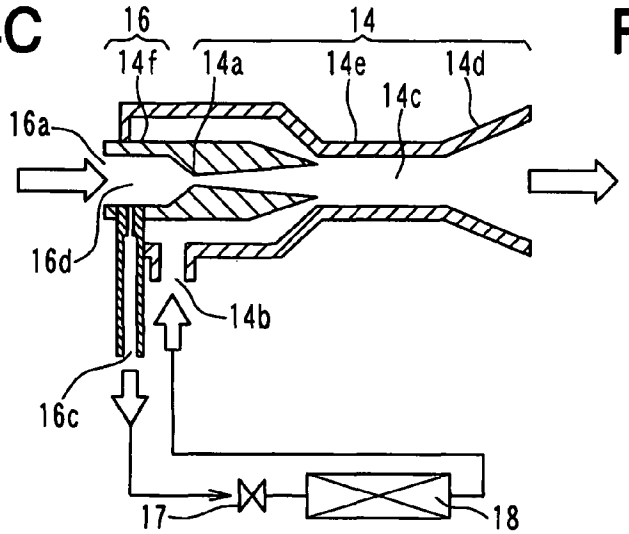

FIGS. 24A to 24D show special examples of the outlet port 16*c*, adapted as a throttle different from the throttle mechanism 17. FIG. 24A shows an example in which a single straight passage is connected to the flow amount distributor 16 to have the outlet port 16*c*, FIG. 24B shows an example in which a taper-straight nozzle combination member is connected to the flow amount distributor 16 to have the outlet port 16*c*, FIG. 24C shows an example in which an orifice-straight passage combination member is connected to the flow amount distributor 16 to have the outlet port 16*c*, and FIG. 24D shows an example in which a capillary tube is connected to the flow amount distributor 16 to have the outlet port 16*c*.

In the examples of FIGS. 24A to 24D, the outlet port 16*c* is open radially outside of the nozzle forming member 14*f*, while the inlet port 16*a* is open in the axial direction. However, the inlet port 16*a* may be open in the nozzle forming member 14*f* in a radial direction, similarly to the examples of FIGS. 23A and 23B.

Other Embodiments

Although the present invention has been fully described in connection with the preferred embodiments thereof with reference to the accompanying drawings, it is to be noted that various changes and modifications will become apparent to those skilled in the art.

(1) At least in the above-described first embodiment, the ejector 14 is accommodated in the ejector case 23, and the ejector case 23 having therein the ejector 14 is attached to the outer surface of the upper tanks 15*b*, 18*b* of the first and second evaporators 15, 18. However, the ejector case 23 may be omitted, and the ejector 14 can be directly attached to the outer surface of the upper tank 15*b*, 18*b* without using the ejector case 23.

(2) In the above-described embodiments, the ejector 14, the flow amount distributor 16, the throttle mechanism 17 and the ejector case 23 are assembled to the top surface of the upper tanks 15*b*, 18*b* of the first and second evaporators 15, 18. However, the ejector 14, the flow amount distributor 16, the throttle mechanism 17 and the ejector case 23 may be assembled to a surface of the first and second evaporators 15, 18, except for the top surface of the upper tanks 15*b*, 18*b*, such as a side surface of the first and second evaporators 15, 18.

(3) Although in the above-mentioned respective embodiments, the vapor-compression subcritical refrigerant cycle has been described in which the refrigerant is a flon-based one, an HC-based one, or the like, whose high pressure does not exceed the critical pressure, the invention may be applied to a vapor-compression supercritical refrigerant cycle which employs the refrigerant, such as carbon dioxide ($CO_2$), whose high pressure exceeds the critical pressure.

In the supercritical refrigerant cycle, only the refrigerant discharged by the compressor 11 dissipates heat in the supercritical state at the radiator 12, and hence is not condensed.

(4) Although in the above-mentioned embodiments, the exemplary ejector 14 is a fixed ejector having the nozzle portion 14*a* with the certain path area, the ejector 14 for use may be a variable ejector having a variable nozzle portion whose path area is adjustable.

For example, the variable nozzle portion may be a mechanism which is configured to adjust the path area by controlling the position of a needle inserted into a passage of the variable nozzle portion using the electric actuator.

(5) Although in the first embodiment and the like, the invention is applied to the refrigeration cycle device adapted for cooling the interior of the vehicle and for the freezer and refrigerator, both the first evaporator 15 whose refrigeration evaporation temperature is high and the second evaporator 18 whose refrigeration evaporation temperature is low may be used for cooling different areas inside the compartment of the vehicle (for example, an area on a front seat side inside the compartment of the vehicle, and an area on a back seat side therein).

Alternatively or additionally, both the first evaporator 15 whose refrigeration evaporation temperature is high and the second evaporator 18 whose refrigeration evaporation temperature is low may be used for cooling the freezer and refrigerator. That is, a refrigeration chamber of the freezer and refrigerator may be cooled by the first evaporator 15 whose refrigeration evaporation temperature is high, while a freezing chamber of the freezer and refrigerator may be cooled by the second evaporator 18 whose refrigeration evaporation temperature is low.

(6) Although in the first embodiment and the like, the thermal expansion valve 13 and the temperature sensing part 13*a* are separately provided from the integrated evaporator unit 20 for the ejector refrigerant cycle device, the thermal expansion valve 13 and the temperature sensing part 13*a* may be integrally incorporated in the integrated evaporator unit 20 for the ejector refrigerant cycle device 10.

(7) It is apparent that although in the above-mentioned respective embodiments, the refrigeration cycle device for the vehicle has been described, the invention can be applied not only to the vehicle, but also to a fixed refrigeration cycle or the like in the same way.

(8) In the above-described embodiments, any two or more embodiments or modification examples thereof may be suitably combined if there are no have any contradiction in the combination.

For example, when the flow amount distributor 16 is adapted as both of a gas-liquid separation portion for separating the refrigerant flowing therein into gas refrigerant and liquid refrigerant and a refrigerant distribution portion for distributing the separated refrigerant into the nozzle portion 41*a* and the second evaporator 18, and when the flow amount distributor 16 and the ejector 14 are arranged in line in the longitudinal direction of the ejector 14, the other configuration in the evaporator unit 20 may be suitably changed without being limited to each example in the above-described embodiments.

Such changes and modifications are to be understood as being within the scope of the present invention as defined by the appended claims.

What is claimed is:

1. An evaporator unit for a refrigerant cycle device, comprising:

an ejector that is provided with a nozzle portion configured to decompress refrigerant, and a refrigerant suction port from which refrigerant is drawn by a high-speed refrigerant flow jetted from the nozzle portion, wherein the refrigerant jetted from the nozzle portion and the refrigerant drawn from the refrigerant suction port are mixed and the mixed refrigerant is discharged from an outlet of the ejector;

a first evaporator coupled to the outlet of the ejector, the first evaporator having tubes through which the refrigerant passes and evaporates via heat exchange with air flowing between the tubes;

a second evaporator coupled to the refrigerant suction port, the second evaporator having tubes through which the refrigerant passes and evaporates via heat exchange with the air flowing between the tubes;

a throttle mechanism connected to a refrigerant inlet side of the second evaporator, the throttle mechanism decompressing the refrigerant flowing into the second evaporator; and a flow amount distributor connected to a refrigerant inlet side of the nozzle portion and to a refrigerant inlet side of the throttle mechanism, and the flow amount distributor being configured to adjust a flow amount of the refrigerant distributed to the nozzle portion and a flow amount of the refrigerant distributed to the second evaporator, wherein the ejector, the first evaporator, the second evaporator, the flow amount distributor and the throttle mechanism are assembled integrally, the flow amount distributor includes both of a gas-liquid separation portion separating the refrigerant flowing therein into gas refrigerant and liquid refrigerant, and a refrigerant distribution portion for distributing the separated refrigerant into the nozzle portion and the second evaporator, the flow amount distributor and the ejector are arranged in line in a longitudinal direction of the ejector, the first evaporator includes:

a first evaporation portion in which the refrigerant flowing out of the outlet of the ejector passes through the tubes in a first direction; and a second evaporation portion in which the refrigerant flowing out of the first evaporation portion passes through the tubes in a second direction that is opposite from the first direction, the second evaporator includes:

a third evaporation portion in which the refrigerant flowing out of the flow amount distributor passes through the tubes in the first direction;

and a fourth evaporation portion in which the refrigerant flowing out of the third evaporation portion passes through the tubes in the second direction, wherein the first evaporation portion is located upstream of the fourth evaporation portion in the flow direction of the air, the second evaporation portion is located upstream of the third evaporation portion in the flow direction of the air;

the ejector includes a body member defining a mixing portion in which the refrigerant jetted from the nozzle portion and the refrigerant drawn from the refrigerant suction portion are mixed, and defining a diffuser portion in which a pressure of the mixed refrigerant is increased by converting speed energy of the mixed refrigerant to pressure energy, the nozzle portion includes a nozzle forming member integrated with the body member, the flow amount distributor includes the nozzle forming member at a position upstream of the nozzle portion;

the nozzle forming member has therein a cylindrical space at a position upstream of the nozzle portion such that refrigerant flows toward the nozzle portion in the cylindrical space while being swirled in the cylindrical space;

the nozzle forming member is provided with an inlet port through which the refrigerant flows into the cylindrical space, and an outlet port connected to the refrigerant inlet side of the throttle mechanism, the inlet port is connected to the cylindrical space in a direction intersecting with an axial direction of the cylindrical space, and the outlet port is provided between the inlet port and the nozzle portion in the axial direction of the cylindrical space.

2. The evaporator unit according to claim 1, wherein the first and second evaporators are arranged adjacent to each other in an air flow direction, each of the first evaporator and the second evaporator includes the tubes in which the refrigerant passes, and a tank disposed at one end side of the tubes and extending in a tank longitudinal direction to distribute the refrigerant into the tubes or to collect the refrigerant from the tubes, and the ejector, the flow amount distributor and the throttle mechanism are assembled to an outer surface of the tanks of the first and second evaporators on a side opposite to the tubes.

3. The evaporator unit according to claim 2, wherein the tank of the first evaporator is provided with a first refrigerant distribution tank portion in which the refrigerant flowing out of the ejector is distributed into the tubes of the first evaporator, and the tank of the second evaporator is provided with a second refrigerant distribution tank portion in which the refrigerant decompressed by the throttle mechanism is distributed into the tubes of the second evaporator, the evaporator unit further comprising a refrigerant storage member located in at least one of the first and second refrigerant distribution tank portions to store the liquid refrigerant, wherein the refrigerant storage member is configured such that the refrigerant overflowing from the refrigerant storage member flows into the tubes.

4. The evaporator unit according to claim 1, wherein the first evaporator includes the tubes in which the refrigerant passes, and a first refrigerant distribution tank portion disposed to distribute the refrigerant flowing out of the ejector into the tubes of the first evaporator, and the second evaporator includes the tubes in which the refrigerant passes, and a second refrigerant distribution tank portion disposed to distribute the refrigerant decompressed by the throttle mechanism into the tubes of the second evaporator, and the evaporator unit further comprising a refrigerant storage member located in at least one of the first and second refrigerant distribution tank portions to store the liquid refrigerant, wherein the refrigerant storage member is configured such that the refrigerant overflowing from the refrigerant storage member flows into the tubes.

5. The evaporator unit according to claim 1, wherein the ejector, the first evaporator, the second evaporator, the flow amount distributor and the throttle mechanism are brazed as an integrated unit.

6. The evaporator unit according to claim 1, further comprising an ejector case in which the ejector is accommodated, wherein the ejector, the first evaporator, the second evaporator, the flow amount distributor, the throttle mechanism and the ejector case are assembled integrally.

7. The evaporator unit according to claim 1, wherein the throttle mechanism is a taper-straight combination nozzle having approximately a funnel shape, and the taper-straight combination nozzle is configured by a taper portion in which an inner diameter is reduced as toward downstream in a refrigerant flow, and a straight portion having a constant inner diameter and extending from a downstream end of the taper portion.

8. The evaporator unit according to claim 1, wherein the flow amount distributor is configured to have a cylindrical space portion extending in a horizontal direction, a first outlet port provided at an axial end portion of the cylindrical space portion such that the refrigerant in the cylindrical space portion flows toward the nozzle portion via the first outlet port, and a second outlet port provided in a cylindrical wall surface of the cylindrical space portion such that the refrigerant in the cylindrical space portion flows toward the throttle mechanism via the second outlet port.

9. The evaporator unit according to claim 8, wherein the second outlet port is provided at a position lower than the first outlet port.

10. The evaporator unit according to claim 8, wherein the nozzle portion has an inlet port that is directly connected to the first outlet port.

11. The evaporator unit according to claim 8, wherein the throttle mechanism is directly connected to the second outlet port.

12. The evaporator unit according to claim 8, wherein the flow amount distributor is configured such that the refrigerant flows in the cylindrical space portion to be swirled therein.

13. The evaporator unit according to claim 1, wherein the flow amount distributor includes a cylindrical wall portion defining a cylindrical space portion, the cylindrical wall portion is configured by a plurality layers overlapped with other, and the throttle mechanism is configured by a helical groove provided between adjacent layers of the cylindrical wall portion.

14. The evaporator unit according to claim 1, wherein the flow amount distributor includes a cylindrical wall portion defining therein a cylindrical space portion, a swirl generating portion configured to generate a swirl movement in the refrigerant flowing from an inlet port into the cylindrical space portion, and the throttle mechanism is provided in the cylindrical wall portion.

15. The evaporator unit according to claim 14, wherein the ejector includes a body member defining a mixing portion in which the refrigerant jetted from the nozzle portion and the refrigerant drawn from the refrigerant suction portion are mixed, and defining a diffuser portion in which a pressure of the mixed refrigerant is increased by converting speed energy of the mixed refrigerant to pressure energy thereof, the nozzle portion is configured by a nozzle forming member, and the nozzle forming member is provided in the body member, and the cylindrical wall portion is molded integrally with the body member.

16. The evaporator unit according to claim 14, wherein the cylindrical wall portion of the flow amount distributor is configured by a plurality of layers overlapped with each other, and the throttle mechanism is provided between adjacent layers in the cylindrical wall portion of the flow amount distributor.

17. The evaporator unit according to claim 1, wherein a cylindrical wall portion of the nozzle forming member, defining the cylindrical space, is provided with the port at a position where the cylindrical space is formed, and the throttle mechanism is provided in the outlet portion port of the flow amount distributor.

18. The evaporator unit according to claim 1, further comprising a passage member connected to a cylindrical wall portion of the nozzle forming member, defining the cylindrical space, wherein the passage member is provided with the outlet port at a downstream end, and the throttle mechanism is coupled to the downstream end of the passage member.

19. The evaporator unit according to claim 1, wherein the flow amount distributor is connected directly to the throttle mechanism.

20. The evaporator unit according to claim 1, wherein the flow amount distributor includes a single inlet port receiving refrigerant from a radiator, a first outlet port connected directly to the nozzle portion and a second outlet port connected directly to the throttle mechanism, the first and second outlet ports being separate from each other and separate from the single inlet port.

21. The evaporator unit according to claim 1, wherein the nozzle portion of the ejector is a non-adjustable nozzle portion.

22. The evaporator unit according to claim 1, wherein the axial direction of the cylindrical space is parallel to the longitudinal direction of the ejector.

23. The evaporator unit according to claim 22, wherein the direction intersecting with the axial direction of the cylindrical space is perpendicular to the axial direction of the cylindrical space.

24. The evaporator unit according to claim 1, wherein the cylindrical space is a circular cylindrical space.

* * * * *